US012486066B2

(12) United States Patent
Bonnain et al.

(10) Patent No.: US 12,486,066 B2
(45) Date of Patent: Dec. 2, 2025

(54) SYSTEMS AND METHODS FOR PACKAGING ARTICLES WITHIN A CARTON

(71) Applicant: WestRock Packaging Systems, LLC, Atlanta, GA (US)

(72) Inventors: Jean-Christophe Bonnain, Châteauroux (FR); Emmanuel Davaillon, Châteauroux (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 18/556,810

(22) PCT Filed: Apr. 22, 2022

(86) PCT No.: PCT/US2022/026000
§ 371 (c)(1),
(2) Date: Oct. 23, 2023

(87) PCT Pub. No.: WO2022/226343
PCT Pub. Date: Oct. 27, 2022

(65) Prior Publication Data

US 2024/0199259 A1 Jun. 20, 2024

Related U.S. Application Data

(60) Provisional application No. 63/178,733, filed on Apr. 23, 2021.

(51) Int. Cl.
*B65B 17/02* (2006.01)
*B65B 35/44* (2006.01)
(Continued)

(52) U.S. Cl.
CPC ..... *B65B 49/12* (2013.01); *B65B 17/025* (2013.01); *B65B 35/44* (2013.01); *B65B 43/10* (2013.01); *B65B 43/265* (2013.01); *B65B 49/14* (2013.01)

(58) Field of Classification Search
USPC ..... 53/48.1
See application file for complete search history.

(56) References Cited

U.S. PATENT DOCUMENTS 3,621,634 A 11/1971 Freakes
3,653,503 A 4/1972 Arneson
(Continued)

FOREIGN PATENT DOCUMENTS

JP 2000006270 A 1/2000
JP 2008030820 A 2/2008

OTHER PUBLICATIONS

International Search Report issued in PCT/US22/26000 mailed on Oct. 27, 2022.
JP Office Action dtd Aug. 26, 2025, 3 pages.

*Primary Examiner* — Chinyere J Rushing-Tucker
(74) *Attorney, Agent, or Firm* — Brian J. Goldberg; Tsugihiko Suzuki; Rohini K. Garg

(57) ABSTRACT

A packaging system includes a conveyor configured to convey a group of articles and a blank along a packaging path. The packaging system includes a folding machine configured to fold a first end panel of the blank relative to a main panel of the blank and to fold a second end panel of the blank relative to the main panel, after the first end panel is folded, as the group of articles and the blank travel along the packaging path. The packaging system includes an alignment machine configured to position a first side panel and a second side panel of the blank at a predetermined angle relative to the main panel as the group of articles and the blank travel along the packaging path.

21 Claims, 20 Drawing Sheets

(51) Int. Cl.

| | |
|---|---|
| ***B65B 43/10*** | (2006.01) |
| ***B65B 43/26*** | (2006.01) |
| ***B65B 49/12*** | (2006.01) |
| ***B65B 49/14*** | (2006.01) |

(56) References Cited

U.S. PATENT DOCUMENTS

| | | | | |
|---|---|---|---|---|
| 5,415,278 | A | 5/1995 | Sutherland | |
| 2010/0022373 | A1* | 1/2010 | LeBras | B65D 71/007 493/52 |
| 2020/0369420 | A1* | 11/2020 | Bonnain | B65B 11/105 |

* cited by examiner

SYSTEMS AND METHODS FOR PACKAGING ARTICLES WITHIN A CARTON

CROSS-REFERENCE TO RELATED APPLICATIONS

The present application is a 35 U.S.C. $$371 national stage application of PCT/US2022/026000 filed on 22 Apr. 2022, which claims the benefit of priority to U.S. Provisional Patent Application Ser. No. 63/178,733 filed on 23 Apr. 2021, the contents of each of which are incorporated herein by reference in their entirety.

FIELD

The present disclosure relates to article packaging and, more particularly, to systems and methods for packaging articles within a carton formed from a blank folded about the articles.

BACKGROUND

In the field of packaging, cartons are often used for carrying multiple articles. Cartons are useful for enabling consumers to transport, store, and access a group of articles for consumption. For cost and environmental considerations, such cartons or carriers need to be formed from as little material as possible and cause as little wastage in the materials from which they are formed as possible. Further considerations include the strength of the carton and its suitability for holding and transporting articles. For example, it is desirable that the articles remain secure within the carton. Additional considerations include the level of automation available to form the carton around the articles. For example, it is desirable for a blank of sheet material to be fed into a packaging machine and automatically formed (e.g., wrapped) about the articles being packaged to form the carton. However, due to the design of the blank and/or the configuration of the carton that addresses the above-mentioned considerations, it can be challenging to automate formation of the carton from the blank using a machine. Accordingly, those skilled in the art continue with research and development efforts in the field of article packaging.

SUMMARY

Disclosed are a packaging system for forming a carton about a group of articles and a packaging method of forming a carton about a group of articles. The following is a non-exhaustive list of examples, which may or may not be claimed, of the subject matter according to the present disclosure.

In an example, the disclosed packaging system includes a conveyor. The conveyor is configured to convey a group of articles and a blank, applied to an upper end of the articles, along a packaging path. The packaging system includes a folding machine. The folding machine is configured to fold a first end panel of the blank relative to a main panel of the blank as the group of articles and the blank travel along the packaging path. The folding machine is configured to fold a second end panel of the blank relative to the main panel of the blank, after the first end panel is folded, as the group of articles and the blank travel along the packaging path. The folding machine is configured to fold a first end flap of the blank relative to the first end panel, after the first end panel is folded, as the group of articles and the blank travel along the packaging path. The folding machine is configured to fold a second end flap of the blank relative to the second end panel, after the second end panel is folded, as the group of articles and the blank travel along a portion of the packaging path. The folding machine is configured to fold a first side panel of the blank relative to the main panel, after the first end flap and the second end flap are folded, as the group of articles and the blank travel along the packaging path. The folding machine is configured to fold a second side panel of the blank relative to the main panel, after the first end flap and the second end flap are folded, as the group of articles and the blank travel along the packaging path. The folding machine is configured to fold a first cover panel of the blank relative to the first side panel, after the first side panel is folded, as the group of articles and the blank travel along the packaging path. The folding machine is configured to fold a second cover panel of the blank relative to the second side panel, after the second side panel is folded, as the group of articles and the blank travel along a portion of the packaging path. The packaging system includes an alignment machine. The alignment machine is configured to position the first side panel and the second side panel at a predetermined angle relative to the main panel, after the first side panel and the second side panel are folded, while the first cover panel and the second cover panel are folded.

In an example, the disclosed packaging system includes a conveyor. The conveyor is configured to convey a group of articles and a blank, applied to an upper end of the articles, along a packaging path. The packaging system includes a folding machine. The folding machine is configured to fold a first end panel of the blank relative to a main panel of the blank as the group of articles and the blank travel along the packaging path. The folding machine is configured to fold a second end panel of the blank relative to the main panel of the blank, after the first end panel is folded, as the group of articles and the blank travel along the packaging path.

In an example, the disclosed packaging system includes a conveyor. The conveyor is configured to convey a group of articles and a blank, folded about the articles, along a packaging path. The packaging system includes an alignment machine. The alignment machine is configured to position a first side panel and a second side panel of the blank at a predetermined angle relative to a main panel of the blank as the group of articles and the blank travel along the packaging path.

In an example, the disclosed packaging method includes steps of: (1) conveying a group of articles and a blank, applied to an upper end of the articles, along a packaging path; (2) folding a first end panel of the blank relative to a main panel of the blank as the group of articles and the blank travel along the packaging path; (3) folding a second end panel of the blank relative to the main panel of the blank, after folding the first end panel, as the group of articles and the blank travel along the packaging path; (4) folding a first end flap of the blank relative to the first end panel, after folding the first end panel, as the group of articles and the blank travel along the packaging path; (5) folding a second end flap of the blank relative to the second end panel, after folding the second end panel, as the group of articles and the blank travel along the packaging path; (6) folding a first side panel of the blank relative to the main panel, after folding the first end flap and the second end flap, as the group of articles and the blank travel along the packaging path; (7) folding a second side panel of the blank relative to the main panel, after folding the first end flap and the second end flap, as the group of articles and the blank travel along the packaging path; (8) positioning the first side panel and the second side panel at a predetermined angle relative to the main panel, after folding the first side panel and the second side panel; (9) folding a first cover panel of the blank relative to the first side panel, while maintaining the first side panel at the predetermined angle, as the group of articles and the blank travel along a portion of the packaging path; and (10) folding a second cover panel of the blank relative to the second side panel, while maintaining the second side panel at the predetermined angle, as the group of articles and the blank travel along a portion of the packaging path.

Other examples of the disclosed packaging system and packaging method will become apparent from the following detailed description, the accompanying drawings, and the appended claims.

DETAILED DESCRIPTION

Figure 7:
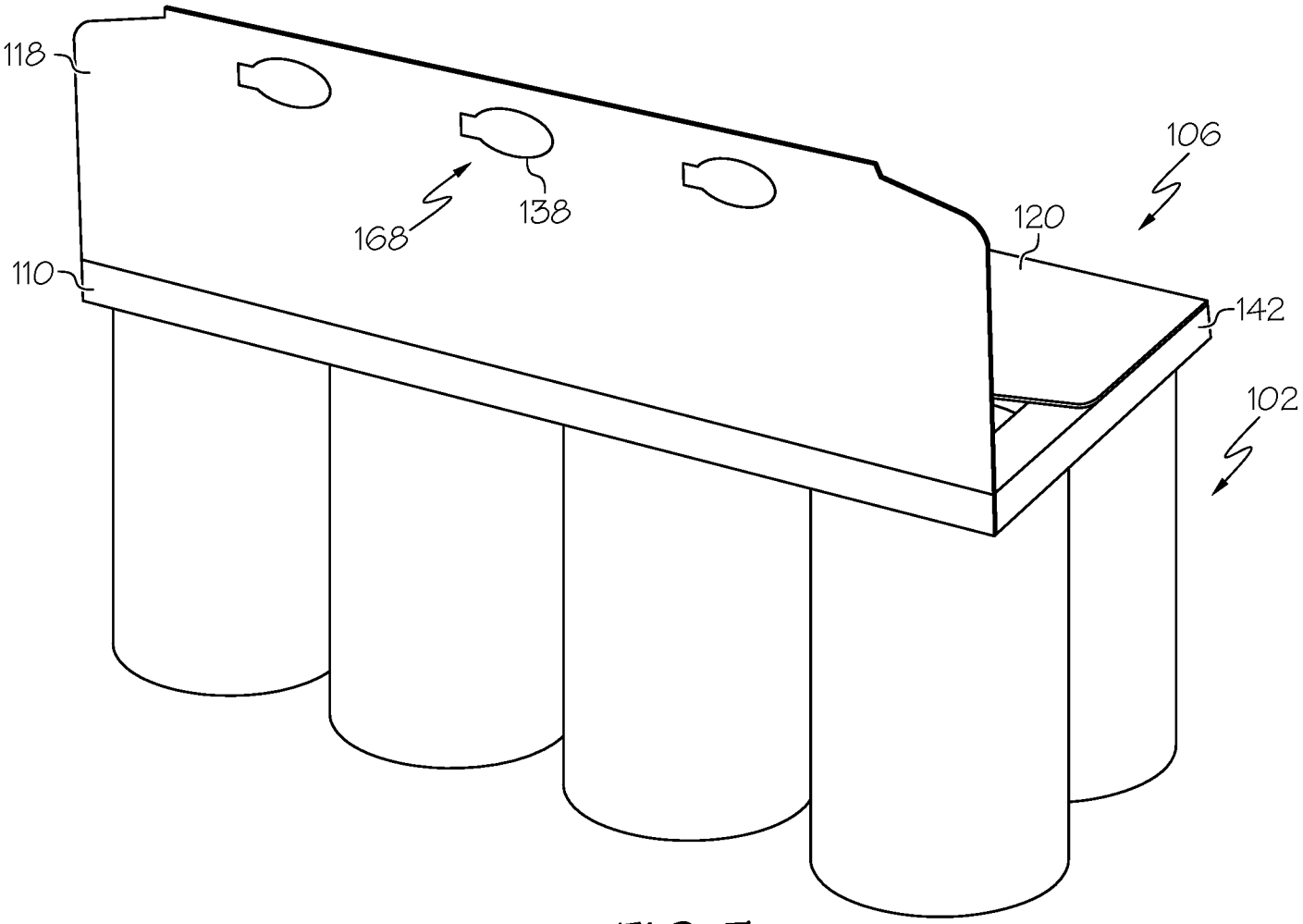
FIG. 7 is a schematic, perspective view of an example of the blank shown with a second cover panel in a folded position.
Figure 8:
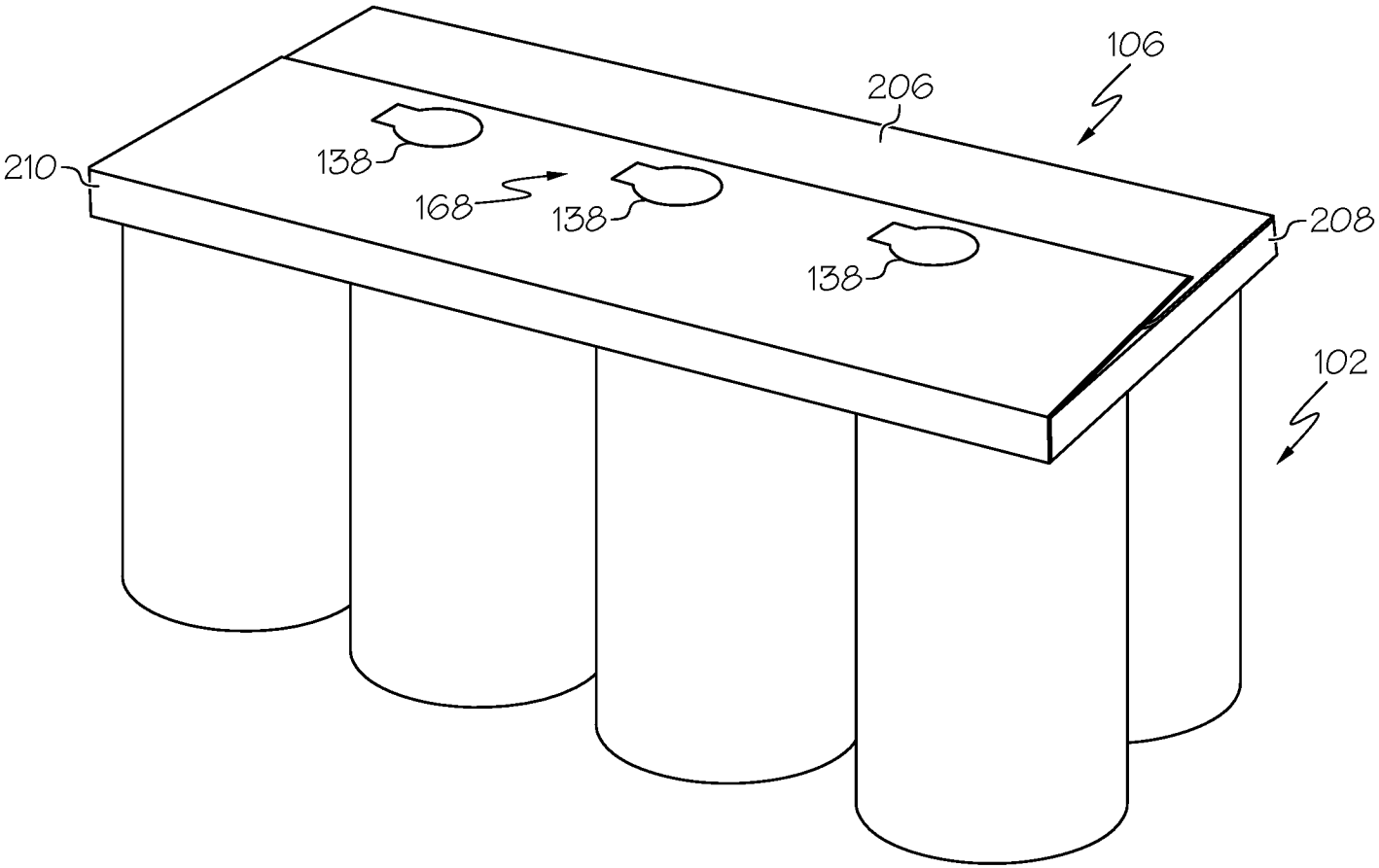
FIG. 8 is a schematic, perspective view of an example of the blank shown with first and second cover panels in a folded position.
Figure 9:
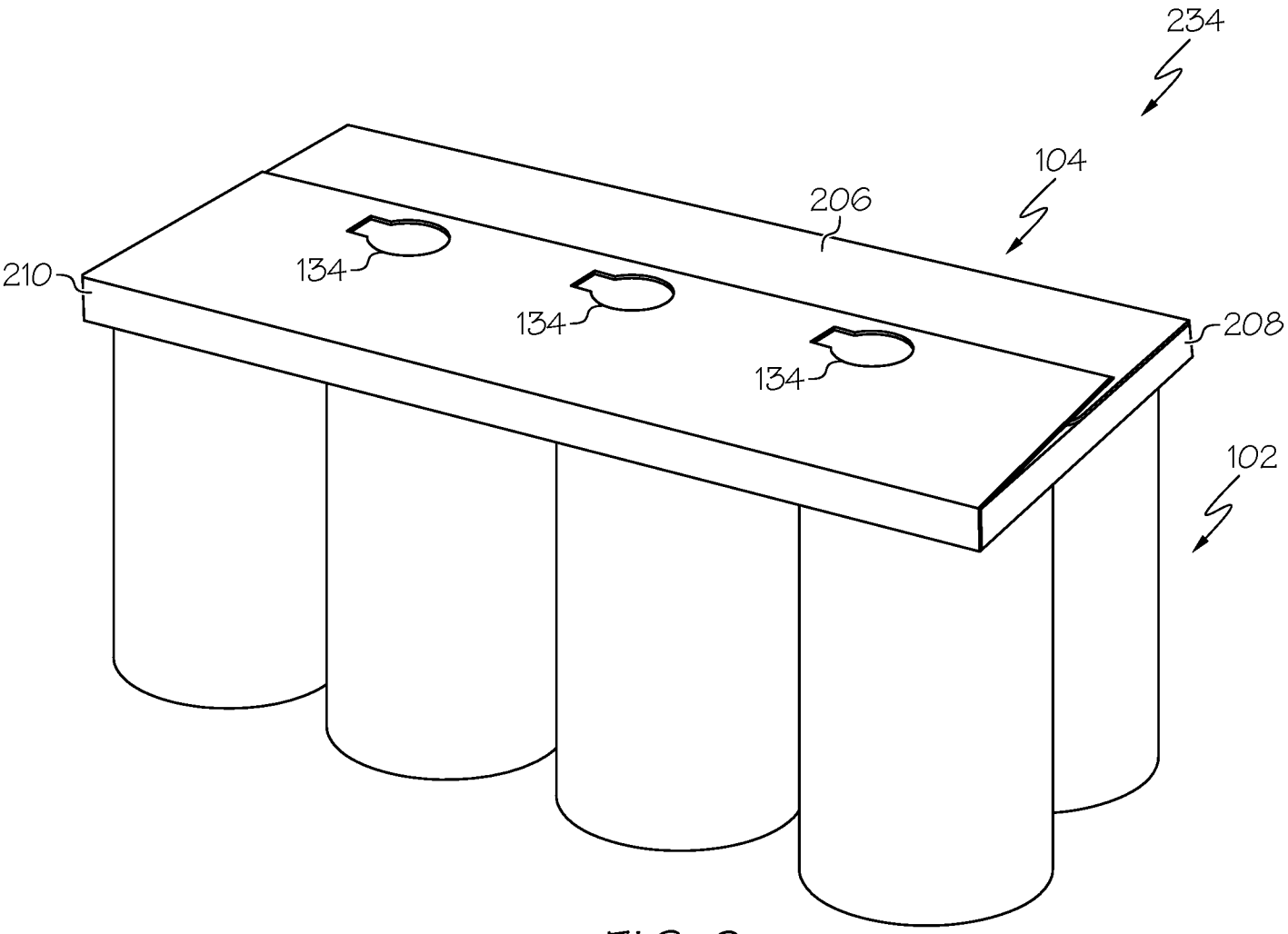
FIG. 9 is a schematic, perspective view of an example of a carton formed from the blank.

Referring to FIGS. 1-9, which schematically illustrate examples of a blank 106 that is configured and used to form a carton 104 (e.g., as shown in FIG. 9). The blank 106 is configured to be folded or otherwise formed about a plurality (e.g., a group) of articles 102 such that at least a portion of each one of the articles 102 is packaged in the carton 104. As such, the carton 104 is configured to contain and carry the articles 102 and may also be referred to as an article carrier or a carrier.

Generally, the article 102 refers to a primary package for product. The carton 104 forms a secondary package for packaging the articles 102 (e.g., at least one primary product container or package). In the examples described herein, the terms "carton," "carrier," and like terms refer to a container for engaging and carrying articles, such as primary product containers. It is contemplated that the examples described herein can be applied to various product containers, which may be, but are not necessarily, tapered and/or cylindrical in shape. Exemplary articles 102 (e.g., containers) include, but are not limited to, bottles (e.g., metallic, glass, or plastics bottles), cans (e.g., aluminum cans), tins, pouches, packets, other similar product containers, and the like.

In one or more examples, the blank 106 is configured to form the carton 104 for packaging an arrangement of articles 102. The articles 102 may be arranged and packaged in the carton 104 in any suitable package configuration, such as in the form of a two pack, a four pack, a six pack (e.g., as shown in FIGS. 2-8), a twelve pack, etc. In the examples illustrated in FIG. 1-9, the arrangement is a 2×4 matrix or array. In the examples illustrated in FIGS. 2-9, two rows of four articles 102 are provided, and the articles 102 are beverage cans, such as 355 ml (12 oz) beverage cans. However, other types of articles 102 and/or other package configurations are also contemplated. As such, the blank 106 can be configured to form the carton 104 for packaging other types, numbers, and/or sizes or articles 102 and/or for packaging articles 102 in different arrangements or configurations.

Figure 1:
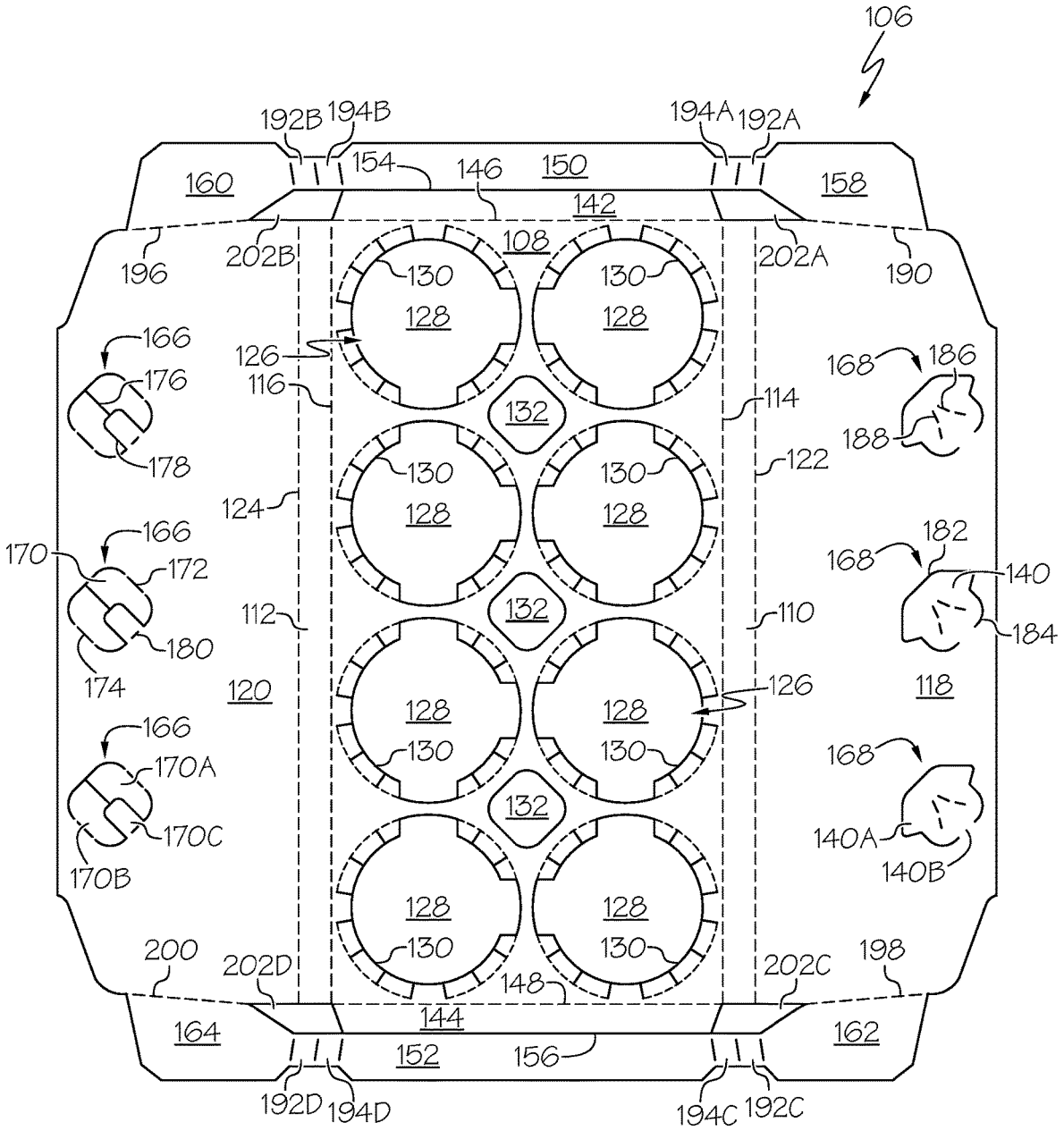
FIG. 1 is a schematic, plan view of an example of a blank for forming a carton.
Figure 2:
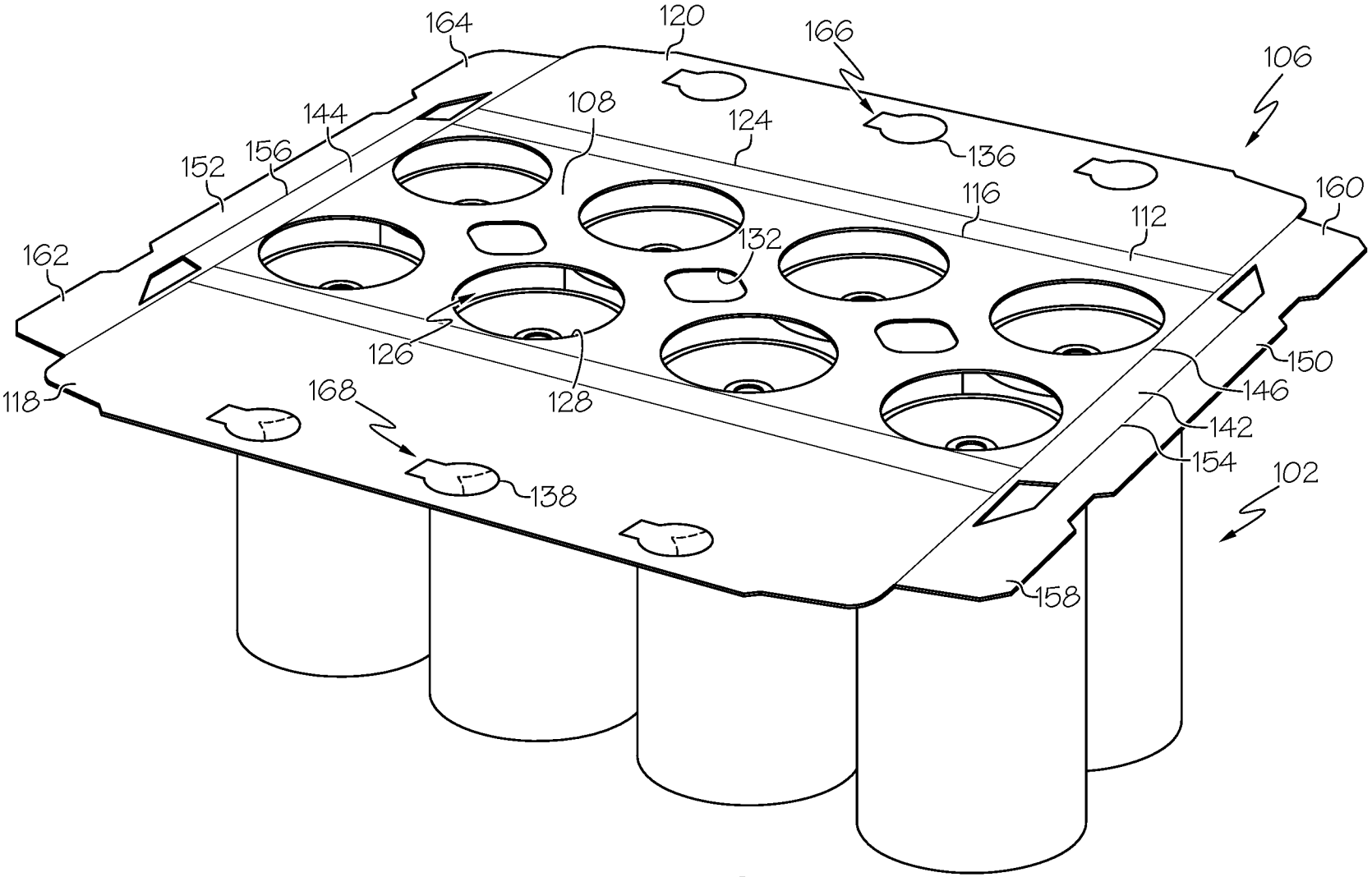
FIG. 2 is a schematic, perspective view of an example of the blank.

Referring to FIGS. 1 and 2, in one or more examples, the blank 106 includes a plurality of panels connected to one another by a plurality of fold lines. Any one of the fold lines and/or hinge lines described herein, may include any suitable predefined or preformed line of weakening and/or line of separation known to those skilled in the art and guided by the teachings herein provided, such as a crease, a score, a perforation, relief cut, or the like. Generally, the fold lines transform the blank 106 into a plurality of separate but integrals panels and flaps that form the carton 104. The preformed lines of weakening enable ease in folding during assembly of the carton 104.

In one or more examples, the blank 106 includes a main panel 108. The main panel 108 of the blank 106 forms a lower wall (e.g., a bottom panel, base panel, or engaging panel) of the carton 104.

In one or more examples, the blank 106 includes a first side panel 110. The first side panel 110 is hingedly connected to a first side of the main panel 108, such as by a hinged connection in the form of a fold line 114. The first side panel 110 forms a first side closure structure 210 (e.g., first side wall) of the carton 104 (e.g., as shown in FIGS. 8 and 9).

In one or more examples, the blank 106 includes a second side panel 112. The second side panel 112 is hingedly connected to a second side of the main panel 108, such as by a hinged connection in the form of a fold line 116. The second side panel 112 forms a second side closure structure 210 (e.g., second side wall) of the carton 104.

In one or more examples, the blank 106 includes a first cover panel 118 (e.g., a first top panel). The first cover panel 118 is hingedly connected to the first side panel 110, such as by a hinged connection in the form of a fold line 122.

In one or more examples, the blank 106 includes a second cover panel 120 (e.g., a second top panel). The second cover panel 120 is hingedly connected to the second side panel 112, such as by a hinged connection in the form of a fold line 124.

In one or more examples, the main panel 108 of the blank 106 includes at least one retention structure 126. The retention structure 126 is configured to retain (e.g., receive, contain, and hold) the article 102. In one or more examples, the main panel 108 includes a plurality of retention structures 126, such as eight retention structures 126 arranged in 2×4 matrix or array (e.g., as shown in FIG. 1).

In one or more example, the retention structure 126 (e.g., each one of the retention structures 126) includes a retention aperture 128 (e.g., an article receiving opening). The retention aperture 128 forms at least part of an article retention opening of the carton 104 and is configured to receive an engage a portion of the article 102 (e.g., as shown in FIG. 2).

Figure 3:
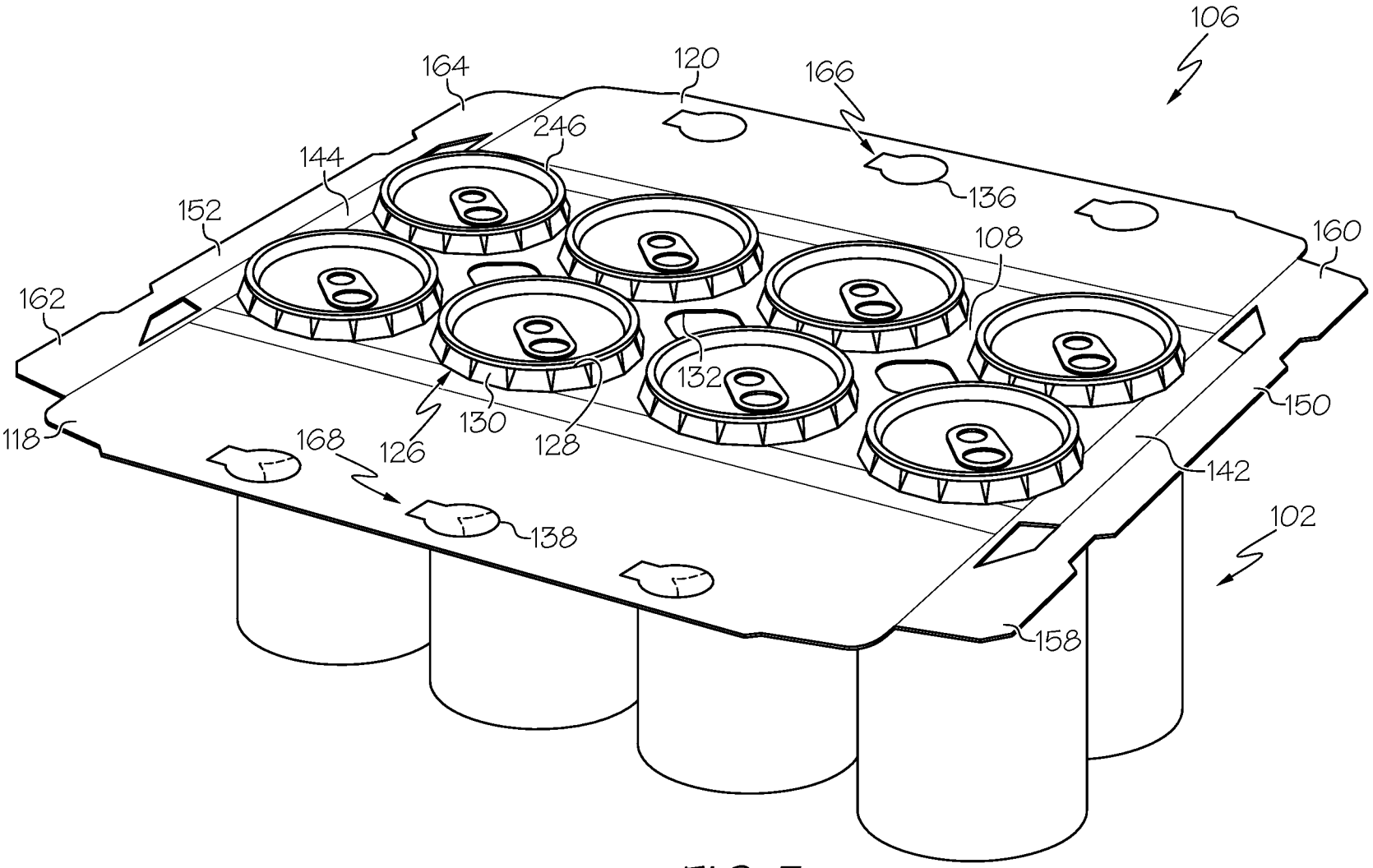
FIG. 3 is a schematic, perspective view of an example of the blank coupled to a group of articles.

Referring now to FIGS. 1 and 3, in one or more examples, the retention structure 126 (e.g., each one of the retention structures 126) includes a plurality of retention tabs 130 (e.g., teeth). The retention tabs 130 are arranged in an annular series about the retention aperture 128. The retention tabs 130 form a part of the article retention opening of the carton 104.

In one or more examples, the retention tabs 130 are provided by (e.g., formed by) the main panel 108. In one or more examples, each one of the retention tabs 130 is hingedly connected to the main panel 108, such as by a hinged connection in the form of a fold line. In one or more examples, the hinged connection is defined by a plurality of cut lines. In one or more examples, the cut lines are arranged as an annular series of cuts about the retention aperture 128.

In one or more examples, each one of the retention tabs 130 includes an engaging edge opposing a hinged edge. The engaging edges are defined by a linear portion of a cut line defining the retention aperture 128. In one or more example, each engaging edge defines a part of a polygon. The blank 106 may include any suitable number of tabs 130, such as twelve tabs 130 together defining a dodecagon, sixteen tabs 130 together defining a hexadecagon, and the like.

In one or more examples, each one of the retention tabs 130 includes a pair of side edges. In one or more examples, the side edges are defined by cuts extending radially outward from respective vertices of the polygon, for example, from a respective vertex between a pair of adjacent linear portions of the cut defining the portion of a polygon. The cuts are divergently arranged with respect to each other and define an angle therebetween, such as an angle of approximately 22.5°.

In one or more examples, the plurality of cut lines may define or approximate a portion of circle. In one or more examples, each one of the plurality of cut lines may be linear in shape. In one or more examples, each one of the plurality of cut lines may be arcuate or curved. In one or more examples, the cut lines may have a radius of curvature that is equal to half the diameter of the retention aperture 128 (e.g., the article retention opening). In one or more examples, the cut lines may have a radius of curvature that is greater than half the diameter of the retention aperture 128 (e.g., article retention opening).

In other examples, the retention structures 126 may take a different form, for example but not limited to, a pair of spaced apart opposing cuts that define a displaceable region forming a cover over an article and providing a pair of opposed engaging edges for engaging opposing sides of an article below a flange, chime, or other projection.

Referring now to FIGS. 1-3, in one or more examples, the main panel 108, the first cover panel 118, and the second cover panel 120 form a handle structure for the carton 104. In one or more examples, the blank 106 includes at least one handle aperture 132. The handle aperture 132 defines or forms at least a portion of a handle opening of the handle structure of the carton 104. In one or more examples, the blank 106 includes a plurality of handle apertures 132, such as three handle apertures 132 (e.g., as shown in FIGS. 1-3). In one or more example, each one of the handle apertures 132 is defined in, cut from, or struck from a region of the main panel 108 disposed centrally between four of the retention apertures 128 arranged as two adjacent pairs of retention apertures 128.

Referring now to FIGS. 8 and 9, in one or more examples, the first cover panel 118 and the second cover panel 120 are arranged to be disposed in at least a partially overlapping relationship with each other. The overlapping portions of the first cover panel 118 and the second cover panel 120 provide at least one locking structure 134 (e.g., as shown in FIG. 9) to the carton 104 for locking the first cover panel 118 and the second cover panel 120 together. In one or more examples, the carton 104 includes a plurality of locking structures 134, such as three locking structures 134. In one or more examples, the locking structure 134 cooperates with the handle aperture 132 (e.g., as shown in FIGS. 1-3) in the main panel 108 to secure the first cover panel 118 and the second cover panel 120 to the main panel 108.

Referring now to FIGS. 1-3, 8 and 9, in one or more examples, the locking structure 134 (e.g., as shown in FIG. 9) includes, or is partially formed from, a receiver 166 (e.g., as shown in FIGS. 1-3) formed in one of the first cover panel 118 or the second cover panel 120 (e.g., as shown in FIGS. 1-3) of the blank 106.

In one or more examples, the blank 106 includes a plurality of receivers 166, such as three receivers 166. In other examples, one, two, or more than three receivers 166 may be provided in the blank 106. In one or more examples, each one of the receivers 166 is arranged to be in vertical registry or alignment with a corresponding one of the handle apertures 132 provided in the main panel 108.

In one or more examples, the receiver 166 includes, or takes the form of, a lock opening 136 (e.g., as shown in FIGS. 2 and 3). In one or more examples, each one of the lock openings 136 is an aperture that is defined in, cut from, or struck from a region of the second cover panel 118.

The lock opening 136 of the receiver 166 may have any suitable two-dimensional shape, such as substantially circular, square, or diamond shape. In one or more examples, corners of the lock opening 136 are rounded or filleted.

In one or more examples, the receiver 166 (e.g., the lock opening 136) includes, is defined by, or takes the form of by at least one receiver tab 170 (e.g., as shown in FIG. 1), which may also be referred to as a female tab. In one or more examples, the receiver 166 (e.g., the lock opening 136) is defined by a plurality of receiver tabs 170, such as three receiver tabs 170 (e.g., identified individually as first receiver tab 170A, second receiver tab 170B, and third receiver tab 170C in FIG. 1). In one or more examples, receiver tabs 170 are defined in, cut from, or struck from a region of the second cover panel 118.

Referring to FIG. 1, in one or more examples, the first receiver tab 170A is hinged to the second cover panel 120 by a first hinged connection in the form of a fold line 172. In one or more examples, the second receiver tab 170B is hinged to the second cover panel 120 by a second hinged connection in the form of a fold line 174. In one or more examples, the second receiver tab 170B is hinged to the second cover panel 120 in opposition to the first receiver tab 170A. In one or more examples, the first receiver tab 170A is separated in part from the second receiver tab 170B by a first cut line 176 (e.g., severance line) and in part by the third receiver tab 170C. In one or more examples, the third receiver tab 170C is defined by a second cut line 178 (e.g., severance line). In one or more examples, the second cut line 178 is substantially 'U' shaped. In one or more examples, the third receiver tab 170C is hinged to the second cover panel 120 by a third hinged connection in the form of a fold line 180. In one or more examples, the third hinged connection is disposed adjacent to the first and/or second hinged connection and may be substantially orthogonal thereto. In one or more examples, the third receiver tab 170C defines a cutout or recess in each of the first receiver tab 170A and the second receiver tab 170B. The cutout or recess is struck from a free end edge opposing the first and second hinged connections, respectively.

Referring again to FIGS. 1-3, 8 and 9, in one or more examples, the locking structure 134 (e.g., as shown in FIG. 9) includes, or is partially formed from, an insert 168 (e.g., as shown in FIGS. 1-3 and 8) formed in the other one of the first cover panel 118 (e.g., as shown in FIGS. 1-3 and 8) or the second cover panel 120 of the blank 106. The insert 168 is configured to be received by and in the receiver 166 (e.g., the lock opening 136).

In one or more examples, the blank 106 includes a plurality of inserts 168, such as three inserts 168. In other examples, one, two, or more than three inserts 168 may be provided in the blank 106. In one or more examples, each one of the inserts 168 is arranged to be in vertical registry or alignment with a corresponding one of the receivers 166 and a corresponding one of the handle apertures 132.

In one or more examples, the insert 168 includes, or takes the form of, a locking element 138 (e.g., as shown in FIGS. 1-3). In one or more examples, the locking element 138 includes, is defined by, or takes the form of at least one insert tab 140 (e.g., as shown in FIG. 1), which may also be referred to as a male tab. In one or more examples, the insert 168 (e.g., the locking element 138) is defines by a plurality of insert tabs 140, such as two tabs 140 (e.g., identified individually as first insert tab 140A and second insert tab 140B in FIG. 1). In one or more examples, insert tabs 140 are defined in, cut from, or struck from a region of the first cover panel 118.

In one or more examples, the insert tab 140 of the locking element 138 (e.g., the insert 168) is arranged to be received in and engageable with a corresponding, or respective, one of the lock openings 136 (e.g., the receiver 166). In one or more examples, the insert tab 140 is arranged to be received in and engageable with a corresponding, or respective, one of the handle apertures 132.

Referring to FIG. 1, in one or more examples, the first insert tab 140A is hinged to the first cover panel 118 by a first hinged connection in the form of a fold line 182. In one or more examples, the second insert tab 140B is hinged to the first cover panel 118 by a second hinged connection in the form of a fold line 184.

In one or more examples, the insert tab 140 includes at least one fold line, such as a pair of fold lines 186 and 188. In one or more examples, the pair of fold lines 186 and 188 may be divergently arranged with respect to each other. In one or more examples, each one of the pair of fold lines 186 and 188 may be non-linear in shape, for example, but not limited to, arcuate or curvilinear in shape. The nonlinear fold lines may encourage the insert tab 140 to return to a planar arrangement to increase security of the insert tab 140 within the lock opening 136 and the handle aperture 132.

In one or more example, the insert tab 140 may be substantially "arrow head" shaped so as to define a pair of opposing shoulders or detents for securely engaging the lock opening 136 and/or the handle aperture 132. Other types and/or configurations of the locking structure 134 are also contemplated.

In one or more examples, the locking structure 134 and the handle aperture 132 define or form the handle opening (e.g., finger holes) of the handle structure of the carton 104 (e.g., as shown in FIG. 9).

Referring to FIG. 9, in one or more examples, the first cover panel 118, the second cover panel 120, the first side panel 110, the second side panel 112, and the main panel 108 form a tubular structure of the carton 104. In one or more examples, each end of the tubular structure of the carton 104 is closed by an end closure structure 208.

Referring again to FIGS. 1 and 2, in one or more examples, the blank 106 includes a first end panel 142. The first end panel 142 is hingedly connected to a first end of the main panel 108, such as by a hinged connection in the form of a fold line 146. The first end panel 142 forms a first end closure structure 208 (e.g., first end wall) of the carton 104 (e.g., as shown in FIGS. 8 and 9).

In one or more examples, the blank 106 includes a first end flap 150. The first end flap 150 is hingedly connected to the first end panel 142, such as by a hinged connection in the form of a fold line 154.

In one or more examples, the blank 106 includes a first anchor flap 158. The first anchor flap 158 is hingedly connected to a first end of the first cover panel 118, such as by a hinged connection in the form of a fold line 190. The first anchor flap 158 is hingedly connected to first end flap 150, such as by a pair of hinged connecting panels and/or fold lines. In one or more examples, the pair of hinged panels form a gusset.

In one or more examples, a first hinged connecting panel 192A is hingedly connected to the first anchor flap 158, such as by a hinged connection in the form of a fold line. A second hinged connecting panel 194A is hingedly connected to the first hinged connecting panel 192A, such as by a hinged connection in the form of a fold line. The second hinged connecting panel 194A is hingedly connected to the first end flap 150, such as by a hinged connection in the form of a fold line.

In one or more examples, the blank 106 includes a second anchor flap 160. The second anchor flap 160 is hingedly connected to a first end of the second cover panel 120, such as by a hinged connection in the form of a fold line 196. The second anchor flap 160 is hingedly connected to first end flap 150, such as by a pair of hinged connecting panels and/or fold lines. In one or more examples, the pair of hinged panels form a gusset.

In one or more examples, a third hinged connecting panel 192B is hingedly connected to the second anchor flap 160, such as by a hinged connection in the form of a fold line. A fourth hinged connecting panel 194B is hingedly connected to the third hinged connecting panel 192B, such as by a hinged connection in the form of a fold line. The fourth hinged connecting panel 194B is hingedly connected to the first end flap 150, such as by a hinged connection in the form of a fold line.

In one or more examples, the first end panel 142 is separated from each of the first anchor flap 158 by an aperture 202A and the second anchor flap 160 by an aperture 202B (e.g., openings) formed in the blank 106. The aperture 202A separates each of the pair of hinged connecting panels 192A and 194A from the first side panel 110. The aperture 202B separates each of the pair of hinged connecting panels 192B and 194B from the second side panel 112.

In one or more examples, the blank 106 includes a second end panel 144. The second end panel 144 is hingedly connected to a second end of the main panel 108, such as by a hinged connection in the form of a fold line 148. The second end panel 144 forms a second end closure structure 208 of the carton 104.

In one or more examples, the blank 106 includes a second end flap 152. The second end flap 152 is hingedly connected to the second end panel 144, such as by a hinged connection in the form of a fold line 156.

In one or more examples, the blank 106 includes a third anchor flap 162. The third anchor flap 162 is hingedly connected to a second end of the first cover panel 118, such as by a hinged connection in the form of a fold line 198. The third anchor flap 162 is hingedly connected to second end flap 152, such as by a pair of hinged connecting panels and/or fold lines. In one or more examples, the pair of hinged panels form a gusset.

In one or more examples, a fifth hinged connecting panel 192C is hingedly connected to the third anchor flap 162, such as by a hinged connection in the form of a fold line. A sixth hinged connecting panel 194C is hingedly connected to the fifth hinged connecting panel 192C, such as by a hinged connection in the form of a fold line. The sixth hinged connecting panel 194C is hingedly connected to the second end flap 152, such as by a hinged connection in the form of a fold line.

In one or more examples, the blank 106 includes a fourth anchor flap 164. The fourth anchor flap 64 is hingedly connected to a second end of the second cover panel 120, such as by a hinged connection in the form of a fold line 200. The fourth anchor flap 164 is hingedly connected to second end flap 152, such as by a pair of hinged connecting panels and/or fold lines. In one or more examples, the pair of hinged panels form a gusset.

In one or more examples, a seventh hinged connecting panel 192D is hingedly connected to the fourth anchor flap 164, such as by a hinged connection in the form of a fold line. An eighth hinged connecting panel 194D is hingedly connected to the seventh hinged connecting panel 192D, such as by a hinged connection in the form of a fold line. The eighth hinged connecting panel 194D is hingedly connected to the second end flap 152, such as by a hinged connection in the form of a fold line.

In one or more examples, the second end panel 144 is separated from each of the third anchor flap 162 by an aperture 202C and the fourth anchor flap 164 by an aperture 202D (e.g., openings) formed in the blank 106. The aperture 202C separates each of the pair of hinged connecting panels 192C and 194C from the first side panel 110. The aperture 202D separates each of the pair of hinged connecting panels 192D and 194D from the second side panel 112.

Referring to FIGS. 1-9, the carton 104 is constructed from the blank 106. FIGS. 1 and 2 illustrate an example of the blank 106. FIG. 3 illustrates the blank 106 applied to the articles 102. FIGS. 4-8 illustrate an example of the blank 106 being formed into an assembled carton 104 (e.g., as shown in FIG. 9). FIG. 9 illustrates the assembled carton 104 with the articles 102 packaged in the carton 104.

Referring to FIGS. 2 and 3, in one or more examples, the blank 106 is aligned with and is applied to a group of articles 102. Each one of the retention structures 126 of the blank 106 is aligned with a respective one of the articles 102 in the group. A portion (e.g., an upper portion) of each one of the articles 102 passes through a corresponding, or respective, retention aperture 128 in the main panel 108. In one or more examples, the retention tabs 130 (e.g., as shown in FIG. 3) of the retention structure 126, about each one of the retention apertures 128, are folded out of the plane of the main panel 108.

In one or more examples, each tab 130 of the main panel 108 is folded about one of the articles 102 received in the respective one of the retention structures 126. In one or more examples, the main panel 108 may deform about the article 102, for example, but not limited to, a shoulder portion of the article 102. In an example in which the article 102 is a can, the shoulder portion may be provide by the neck-in.

Figure 4:
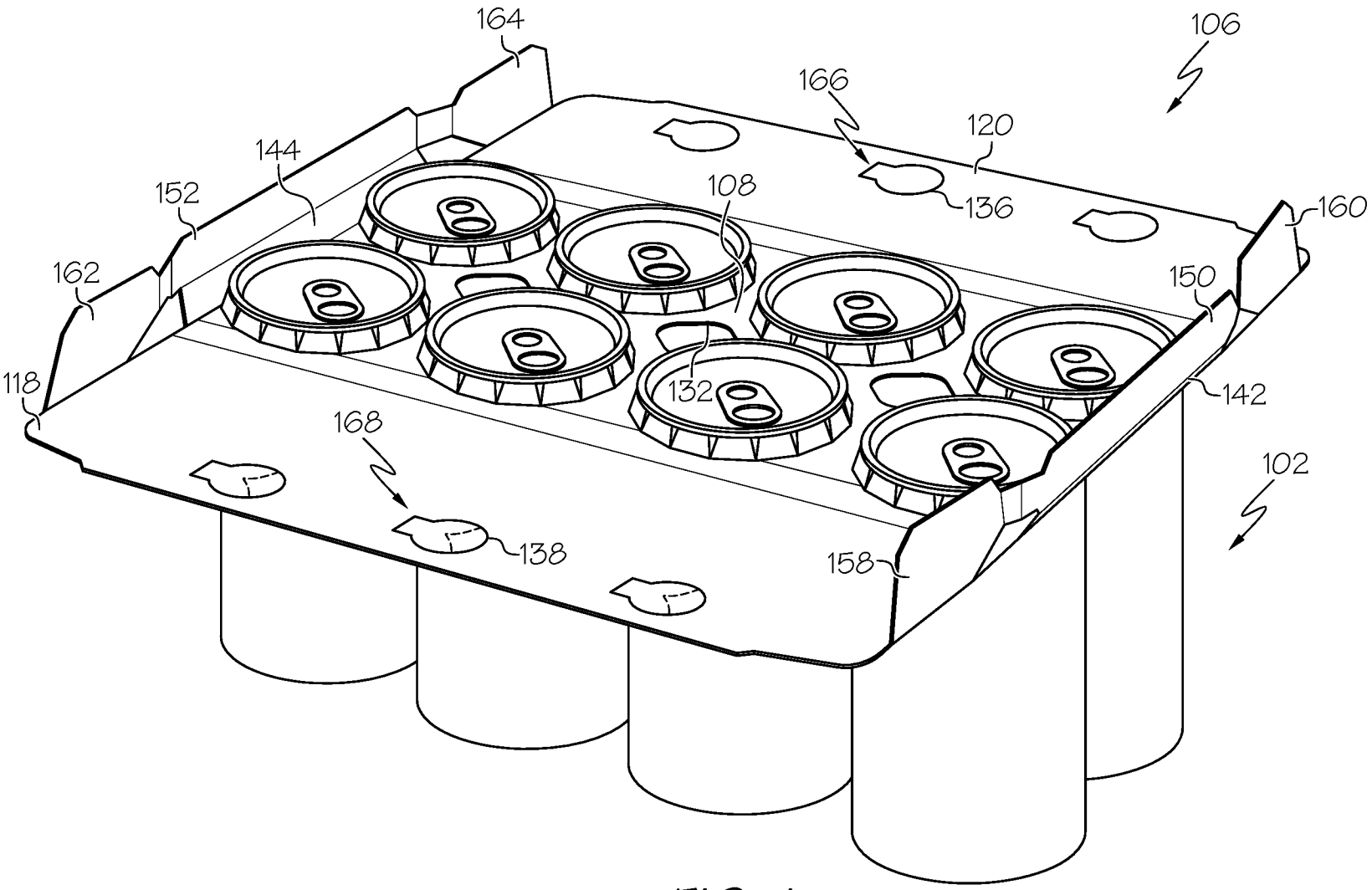
FIG. 4 is a schematic, perspective view of an example of the blank shown with first and second end panels in a folded position.

Referring to FIG. 4, in one or more examples, the blank 106 is folded about respective fold lines (e.g., fold lines 146 shown in FIGS. 1 and 2) to bring the first end panel 142 into a non-coplanar relationship with the main panel 108, such as approximately, or at least substantially, perpendicular to the main panel 108. In one or more examples, the first end panel 142 is folded through an angle greater than 90° so as to be inclined.

In one or more examples, the blank 106 is folded about respective fold lines (e.g., fold line 148 shown in FIGS. 1 and 2) to bring the second end panel 144 into a non-coplanar relationship with the main panel 108, such as approximately, or at least substantially, perpendicular to the main panel 108. In one or more examples, the second end panel 144 is folded through an angle greater than 90° so as to be inclined.

Figure 5:
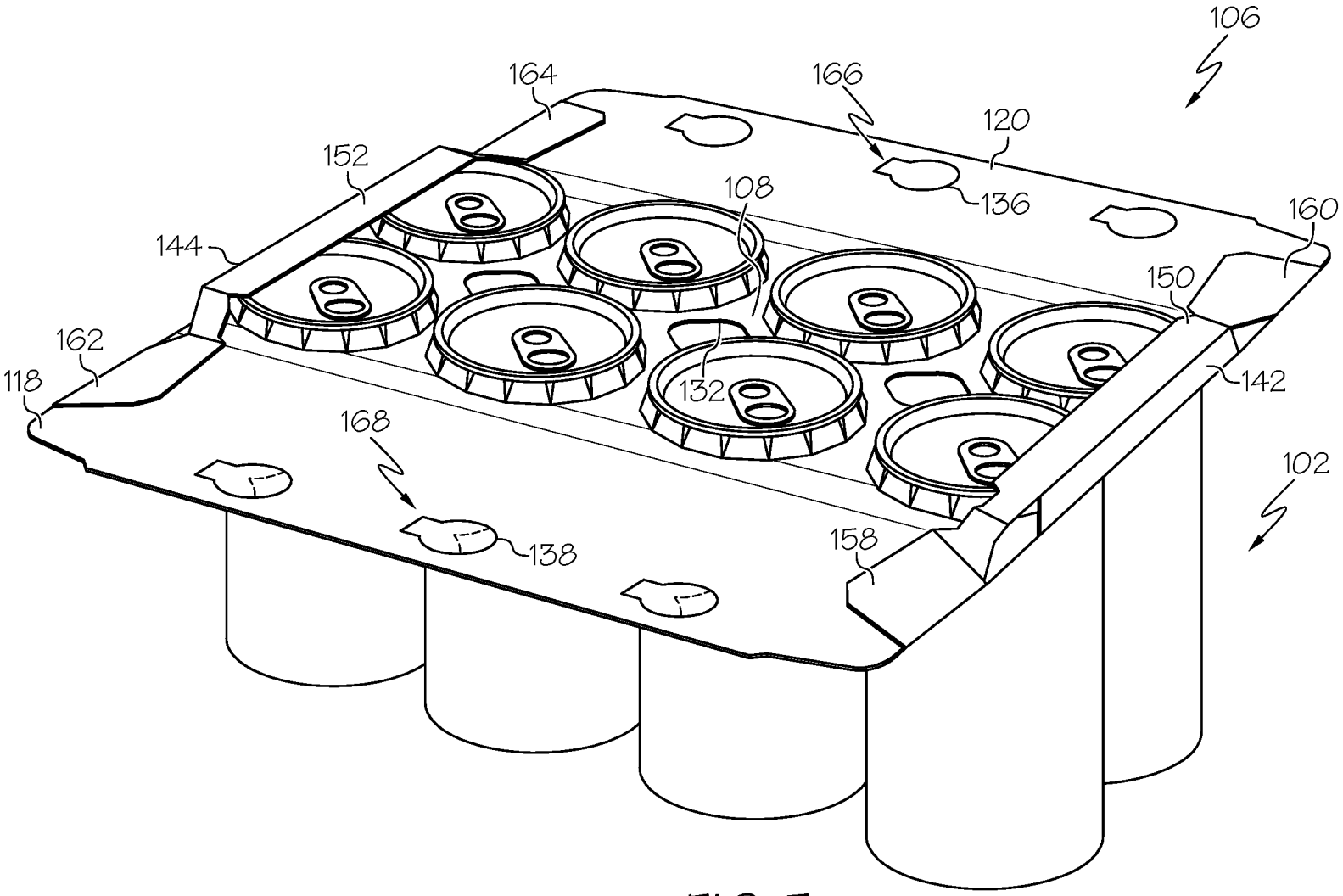
FIG. 5 is a schematic, perspective view of an example of the blank shown with first and second end flaps in a folded position.

Referring to FIG. 5, in one or more examples, the blank 106 is folded about respective fold lines (e.g., fold line 154 shown in FIGS. 1 and 2) to bring the first end flap 150 into a non-coplanar relationship with, such as approximately, or at least substantially, perpendicular to, the first end panel 142 and to bring the first anchor flap 158 and the second anchor flap 160 into a substantially face-to-face relationship with a respective one of the first cover panel 118 and the second cover panel 120 to which they are hinged.

In one or more examples, the blank 106 is folded about respective fold lines (e.g., fold line 156 shown in FIGS. 1 and 2) to bring the second end flap 152 into a non-coplanar relationship with, such as approximately, or at least substantially, perpendicular to, the second end panel 144 and to bring the third anchor flap 162 and the fourth anchor flap 164 into a substantially face-to-face relationship with a respective one of the first cover panel 118 and the second cover panel 120 to which they are hinged.

In one or more examples, the first end flap 150 and the second end flap 152 are folded over an upper end of an article 102, or articles 102, disposed adjacent to the first and second end of the main panel 108.

In one or more examples, the first end flap 150 and the second end flap 152 are folded to be approximately, or at least substantially, parallel to the main panel 108.

In one or more examples, the first anchor flap 158 and the second anchor flap 160 are folded automatically and brought into substantially face-to-face relationship with the respective one of the first cover panel 118 and the second cover panel 120 to which they are hinged in response to folding the first end flap 150 relative to the first end panel 142.

In one or more examples, the third anchor flap 162 and the fourth anchor flap 164 are folded automatically and brought into substantially face-to-face relationship with the respective one of the first cover panel 118 and the second cover panel 120 to which they are hinged in response to folding the second end flap 152 relative to the second end panel 144.

Figure 6:
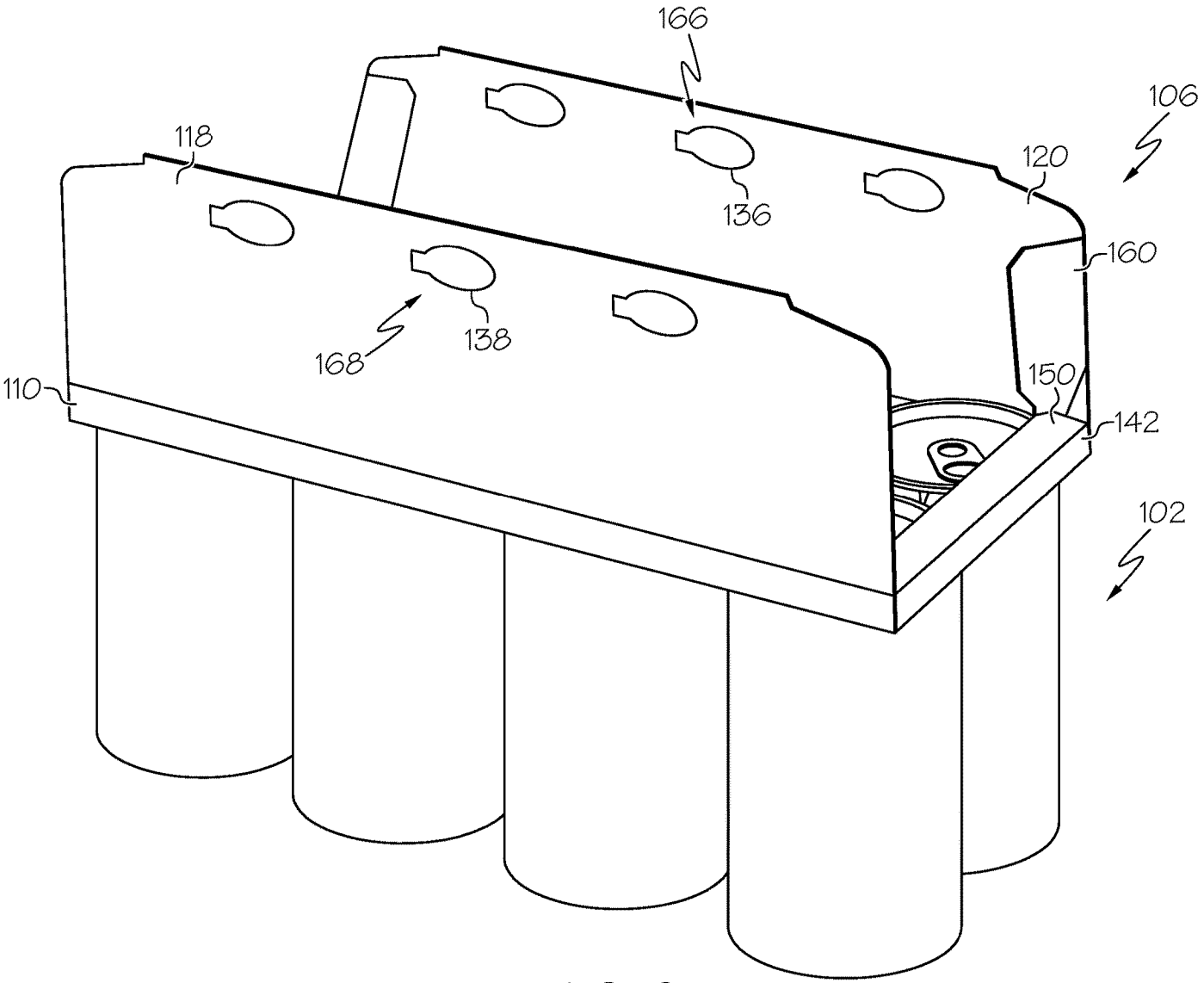
FIG. 6 is a schematic, perspective view of an example of the blank shown with first and second side panels in a folded position.

Referring to FIG. 6, in one or more examples, the blank 106 is folded about respective fold lines (e.g., fold line 114 shown in FIGS. 1 and 2) to bring the first side panel 110 into a non-coplanar relationship with the main panel 108, such as approximately, or at least substantially, perpendicular to the main panel 108. In one or more examples, the first side panel 110 is folded through an angle greater than 90° so as to be inclined.

In one or more examples, the blank 106 is folded about respective fold lines (e.g., fold lines (e.g., fold line 116 shown in FIGS. 1 and 2) to bring the second side panel 112 into a non-coplanar relationship with the main panel 108, such as approximately, or at least substantially, perpendicular to the main panel 108. In one or more examples, the second side panel 112 is folded through an angle greater than 90° so as to be inclined.

Referring to FIG. 7, in one or more examples, the blank 106 is folded about respective fold line (e.g., fold line 124 shown in FIGS. 1 and 2) to bring the second cover panel 120 into a non-coplanar relationship with the second side panel 112, such as approximately, or at least substantially, perpendicular to the second side panel 112. In one or more examples, the second cover panel 120 is folded over the tops of the articles 102.

Referring to FIG. 8, in one or more examples, the blank 106 is folded about respective fold line (e.g., fold line 122 shown in FIGS. 1 and 2) to bring the first cover panel 118 into a non-coplanar relationship with the first side panel 110, such as approximately, or at least substantially, perpendicular to the first side panel 110. In one or more examples, the first cover panel 118 is folded over the tops of the articles 102 and into an overlapping relationship with the second cover panel 120 to form a composite cover panel structure 206 (e.g., upper wall) of the carton 104 (e.g., as shown in FIGS. 8 and 9).

Referring to FIGS. 8 and 9, in one or more examples, each one of the inserts 168 is registered to and aligned with a corresponding, or respective, one of the receivers 166 in response to the first cover panel 118 being folded into an overlapping relationship with the second cover panel 120. The locking element 138 of each one of the inserts 168 is engaged with the lock opening 136 of the corresponding, or respective, one of the receivers 166 to secure (e.g., couple or connect) the first cover panel 118 to the second cover panel 120. The locking element 138 of each one of the inserts 168 may also be engaged with corresponding, or respective, one of the handle apertures 132 to secure (e.g., couple or connect) the first cover panel 118 and the second cover panel 120 to the main panel 108.

In one or more examples, the insert tabs 140 (e.g., as shown in FIG. 1) of the locking element 138 are displaced out of the plane of the first cover panel 118, downwardly, to pass through the corresponding, or respective, lock opening 136. In one or more examples, the receiver tabs 170 are displaced out of the plane of the second cover panel 120, downwardly, in response to the downward displacement of the insert tabs 140. In one or more examples, engagement between the insert tabs 140 and the lock opening 136, such as with the receiver tabs 170, prevent or inhibit disengagement of the insert tabs 140 from the locking condition.

In one or more examples, the insert tabs 140 and the receiver tabs 170 may also serve to function as a spacer between the composite cover panel structure 206 of the carton 104, formed by the first cover panel 118 and the second cover panel 120, and the main panel 108. In one or more examples, the insert tabs 140 and/or the receiver tabs 170 may engage the main panel 108 along perimeters of the handle apertures 132 and/or a lower surface of the main panel 108. In one or more examples, the insert tabs 140 and/or the receiver tabs 170 may thereby serve as tension members for maintaining a spacing between the main panel 108 and the composite cover panel structure 206 to prevent the spacing from increasing. Additionally, the insert tabs 140 and/or the receiver tabs 170 may engage or abut with inside or upper surface of the main panel 108 and may thereby brace between the composite cover panel structure 206 and the main panel 312 to maintain a spacing therebetween to assist in preventing the spacing from decreasing. Thus, at least a portion of one or more insert tabs 140 and/or at least a portion of one or more of the receiver tabs 170 may be disposed between the second cover panel 120 and the main panel 108 to maintain a spacing therebetween.

In one or more examples, at least a portion of one or more insert tabs 140 and/or at least a portion of one or more of the receiver tabs 170 engage the main panel 108 and extend through a corresponding, or respective, handle aperture 132 of the main panel 108 when folded. For example, shoulders of the insert tab 140 and/or the receiver tab 170 may engage with an underside of the main panel 108. The underside of the main panel 108 being a second side of the main panel 108 opposing a first side through which the insert tab 170 is received. In one or more examples, at least one of the insert tabs 140 and/or the receiver tabs 170 may provide a biasing mechanism. For example, one of the receiver tabs 170 (e.g., the third receiver tab 170C) has a natural or inherent tendency to return to an unfolded condition. This may provide, or supplement, the resilient bias of the insert tab 140 to return to an unfolded condition. The receiver tab 170 may encourage the insert tab 140 towards an end stop defined by a recessed edge of the receiver tabs 170 (e.g., the first receiver tab 170A and second receiver tab 170B). The end stop inhibits or prevents the insert tab 170 from returning to the unfolded condition.

Referring now to FIGS. 10-20, by way of examples, the present disclosure is directed to a packaging system 100. The present disclosure is also directed to portions, subsystems, or machines of the packaging system 100.

The packaging system 100 is configured to package the articles 102 within the carton 104 by forming the blank 106 about the articles 102. The carton 104 is formed from the blank 106 (e.g., as shown in FIGS. 1 and 2). The blank 106 is folded or formed about the articles 102 (e.g., as shown in FIGS. 3-8). The articles 102 are packaged within the carton 104 (e.g., as shown in FIGS. 8 and 9). The carton 104 filled with the group of articles 102 is also referred to herein as a completed package 234 (e.g., as shown in FIG. 9).

In one or more examples, the packaging system 100 is a continuous motion packaging system for continuously packaging the group of articles 102 within the carton 104. In one or more examples, the packaging system 100 is configured to continuously process multiple blanks 106 to form (e.g., construct or assemble) multiple completed cartons 104 filled with multiple groups of the articles 102 (e.g., multiple completed packages 234).

While the examples generally illustrated in FIGS. 10-19, show a group of cans being packaged within the carton 104, those skilled in the art will recognize that various other products or articles 102 such as bottles or other similar products containers can be wrapped or otherwise packaged in cartons 104 moving through the packaging system 100. The carton 104 includes a flat, wrap style blank 106 that is designed to fold or be otherwise wrapped about the group of articles 102 received through the main panel 108 of the blank 106 (e.g., the bottom or base panel of the carton 104).

In one or more examples, the blank 106 includes the main panel 108, the first side panel 110, the second side panel 112, the first cover panel 118, the second cover panel 120, the first end panel 142, the second end panel 144, the first end flap 150, the second end flap 152, the first anchor flap 158, the second anchor flap 160, the third anchor flap 162, and the fourth anchor flap 164 (e.g., as shown in FIGS. 1 and 2), which are folded to form the completed carton 104 (e.g., as shown in FIGS. 3-9). The first cover panel 118 and the second cover panel 120 are folded into an overlying relationship and are be secured, or otherwise coupled, together. In one or more examples, the first cover panel 118 and the second cover panel 120 are secured together using the retention structures 126 (e.g., as shown in FIG. 9). In other examples, the first cover panel 118 and the second cover panel 120 are, additionally or alternatively, secured together using adhesives.

Figure 10:
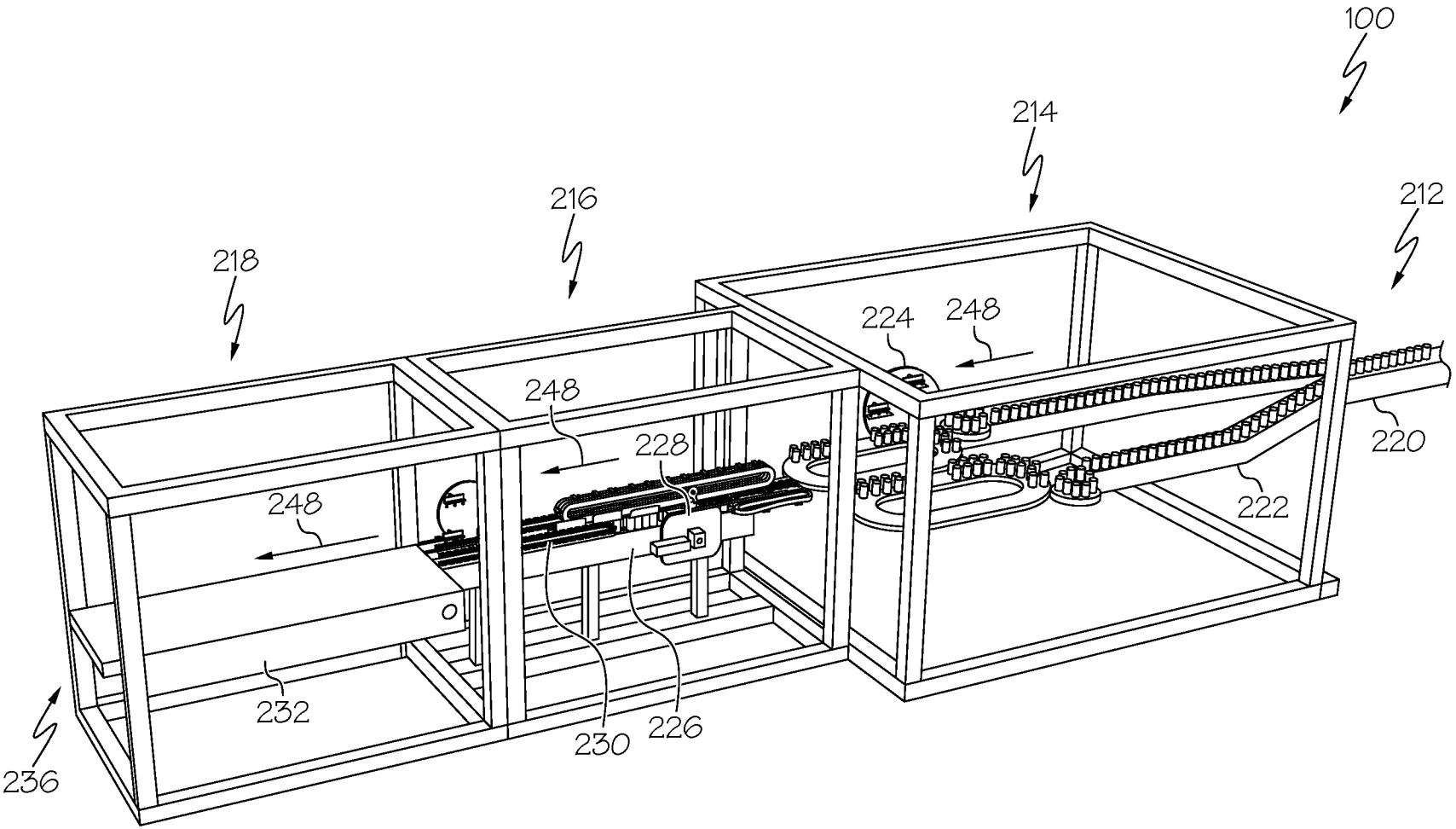
FIG. 10 is a schematic illustration of an example of a packaging system.

Referring to FIG. 10, in one or more examples, the packaging system 100 includes a plurality of stations, stages, modules, sub-systems, and/or machines. Each one of the stations is configured to perform (e.g., automatically or semi-automatically perform) one or more packaging operation. In one or more examples, the packaging system 100 includes a first station 212, a second station 214, a third station 216, and a fourth station 218. However, in other examples, the packaging system 100 may include other numbers and/or types of station, such as less than four stations or more than four stations.

In one or more examples, the packaging operation, or operations, described in association with any one of the stations may be associated with a different one of the stations or may be associated with an additional station that is configured to perform that discrete operation. Further, not every operation associated with packaging the articles 102 and/or forming the carton 104 is necessarily described in detail herein or associated with a particular station of the packaging system 100. As such, certain packaging operations, components, and/or materials, such as those that are well known or common in the industry, are not necessarily described in detail. Accordingly, the illustrative examples of the packaging system 100 and/or any one of the stations is not meant to imply structural or operational limitations with respect to the illustrative example.

In one or more examples, the first station 212 is configured to transport (e.g., continuously transport) a plurality of the articles 102 for packaging. In one or more examples, the first station 212 receives the articles 102, which are output in a non-uniform and rapid manner from a filling or bottling line (not shown) and which are deliver on a mass conveyor (not shown).

In one or more examples, the second station 214 is connected to, such as in series with, the first station 212. In one or more examples, the second station 214 is configured to receive the articles 102 from the first station 212. In one or more examples, the second station 214 is further configured to group the articles 102 (e.g., as shown in FIG. 2). In one or more examples, the second station is also configured to apply the blank 106 to the group of articles 102 (e.g., as shown in FIG. 3).

In one or more examples, the third station 216 is connected to, such as in series with, the second station 214. In one or more examples, the third station 216 is configured to receive the group of articles 102 and the blank 106, applied to the articles 102, from the second station 214. In one or more examples, the third station 216 is further configured to fold the blank 106 about the group of articles 102 to form the carton 104 (e.g., as shown in FIGS. 4-9).

In one or more examples, the fourth station 218 is connected to, such as in series with, the third station 216. In one or more examples, the fourth station 218 is configured to receive the completed package 234 (e.g., the fully formed carton 104 and the group of articles 102 packaged in the carton 104 as shown in FIG. 9) from the third station 216. In one or more examples, the fourth station 218 is further configured to transport and discharge the completed package 234.

In one or more examples, the packaging system 100 includes a conveyor 236. The conveyor 236 is configured to convey (e.g., continuously convey) the articles 102 and the blank 106 along a packaging path. The packaging path defines a direction of travel (e.g., as indicated by directional arrows 248 shown in FIG. 10) of the articles 102 and the blank 106 during formation of the carton 104.

In one or more examples, the conveyor 236 includes a plurality of portions associated with certain packaging operations performed by the system 100. In one or more examples, the conveyor 236 includes a feed conveyor 220, a grouping conveyor 222, an assembly conveyor 226, and a discharge conveyor 232, each of which forming portions of the conveyor 236 of the packaging system 100. The conveyor 236, such as one or more of the feed conveyor 220, the grouping conveyor 222, the assembly conveyor 226, and the discharge conveyor 232, include any suitable features and/or components common to automated conveyor lines and configured to convey articles along an upper surface thereof, such as rollers, belts, endless chains, side lugs, front lugs, rear lugs, drive mechanisms, and the like.

In one or more examples, the feed conveyor 220 forms a portion of the first station 212. The feed conveyor 220 may also be referred to as an article feed conveyor or first conveyor. The feed conveyor 220 is configured to transport a series of the articles 102 along an article infeed path (e.g., a portion of the packaging path), such as in discrete lines or lanes defined by lane guides, as the articles 102 enter the packaging system 100 at an upstream end thereof. The lane guides are configured to maintain the articles 102 in their respective lanes and redirect the line of articles 102 toward an arranging and loading position.

In one or more examples, the packaging system 100 includes a processing machine (not shown). In one or more examples, the processing machine forms a portion of the first station 212. The processing machine is configured to receive and funnel an incoming mass of articles 102 into one or more lanes to create an incoming stream of articles 102, such as that is one or two articles wide. The incoming stream of articles 102 is conveyed on the feed conveyor 220.

In one or more examples, the grouping conveyor 222 forms a portion of the second station 214. The grouping conveyor 222 may also be referred to as an article grouping conveyor or second conveyor. In one or more examples, the grouping conveyor 222 is in communication with the feed conveyor 220. The stream of articles 102 is transferred from the feed conveyor 220 to the grouping conveyor 222.

In one or more examples, the grouping conveyor 222 is configured to arrange a series of articles 102 (e.g., from the stream of articles 102) in a suitable package configuration, such as a group of articles 102 in a 2×4 matrix or array. For example, the grouping conveyor 222 is configured to separate the series of articles 102 into groups of the correct number of articles 102 per blank 106. In one or more examples, the grouping conveyor 222 is configured to transport the series of articles 102 along one or more article grouping paths, such as in discrete lines or lanes defined by lane guides, as the articles 102 enter the grouping conveyor 222 at an upstream end thereof (e.g., from the feed conveyor 220) and move along the grouping conveyor 222. The lane guides are configured to maintain the articles 102 in their respective lanes and redirect the lines of articles 102 for arrangement in the group and for application of the blank 106.

In one or more examples, the packaging system 100 includes a machine for applying the blank 106 to the articles 102, referred to herein as applicator machine 224. The applicator machine 224 may also be referred to as a blank applicator machine. In one or more examples, the applicator machine 224 forms a portion of the second station 214.

In one or more examples, the applicator machine 224 is configured to retrieve (e.g., pick up) the blank 106. In one or more examples, the applicator machine 224 is configured to transfer the blank 106 to the grouping conveyor 222. In one or more examples, the applicator machine 224 is configured to apply the blank 106 to the arranged group of articles 102.

In one or more examples, the applicator machine 224 is configured to apply the blank 106 to the group of articles 102 such that upper ends 246 of the articles 102 extend through the main panel 108 of the blank 106 (e.g., pass through the retention aperture 128) and are retained by the retention structures 126 (e.g., as shown in FIG. 3). In one or more examples, the applicator machine 224 is configured to position the blank 106 over the group of articles 102 (e.g., as shown in FIG. 2) and press the blank 106 downwardly onto the group of articles 102 to load the group of articles 102 into the main panel 108 of the blank 106 (e.g., as shown in FIG. 3).

In one or more examples, the packaging system 100 includes a hopper (not shown) in which a plurality of blanks 106, in a flat condition, are held ready for processing. In one or more examples, the hopper forms a portion of the second station 214. The blanks 106 are retrieved (e.g., received or removed) from the hopper by the applicator machine 224.

In one or more examples, the applicator machine 224 includes, or takes the form of, a rotary vacuum feeder (not shown). In one or more examples, the rotary vacuum feeder includes a plurality of grippers (e.g., suction cups coupled to a vacuum system). The grippers are connected to a rotating wheel unit driven by a drive shaft. A drive mechanism, such as a servo motor, is used to rotate the drive shaft.

In other examples, the applicator machine 224 may include additional or alternative components and/or operate in different manners. In one or more examples, the applicator machine 224 may include, or take the form of, any one of various other machines or tool heads configured to retrieve the blank 106, position the blank 106 relative to the group of articles 102, and apply the blank 106 to the group of articles 102.

In one or more examples, the assembly conveyor 226 forms a portion of the third station 216. The assembly conveyor 226 may also be referred to as a carton assembly conveyor or third conveyor. In one or more examples, the assembly conveyor 226 is in communication with the grouping conveyor 222. The group of articles 102, with the blank 106 applied thereto, is transferred from the grouping conveyor 222 to the assembly conveyor 226.

In one or more examples, the assembly conveyor 226 is configured to transport the group of articles 102, with the blank 106 secured to the articles 102, along a carton assembly path, such as in discrete lines or lanes defined by lane guides, as the group of articles 102 and the blank 106 enter the assembly conveyor 226 at an upstream end thereof (e.g., from the grouping conveyor 222) and move along the assembly conveyor 226. The lane guides are configured to maintain the group of articles 102 and the blank 106 in their respective lanes for folding the blank 106 about the group of articles 102 to assemble the carton 104.

In one or more examples, the packing system 100 includes a machine for folding the blank 106 about the articles 102, referred to herein as a folding machine 228. The folding machine 228 may also be referred to as a blank folding machine. In one or more examples, the folding machine 228 forms a portion of the third station 216.

In one or more examples, the folding machine 228 is configured to fold portions of the blank 106, such as the first end panel 142, the second end panel 144, the first end flap 150, and the second end flap 152 of the blank 106 (e.g., as shown in FIGS. 4 and 5), about the group of articles 102, to partially form the carton 104. In one or more examples, the folding machine 228 is configured to fold other portions of the blank 106, such as the first side panel 110, the second side panel 112, the first cover panel 118, and the second cover panel 120 of the blank 106 (e.g., as shown in FIGS. 6-8), about the group of articles 102, to fully form the carton 104.

In one or more examples, the packaging system 100 includes a machine for aligning the blank 106 during formation of the carton 104, referred to herein as an alignment machine 230. The alignment machine 230 may also be referred to as a blank alignment machine. In one or more examples, the alignment machine 230 forms a portion of the third station 216.

In one or more examples, the alignment machine 230 is configured to suitably position the blank 106 while portions of the blank 106, such as the first cover panel 118 and the second cover panel 120, are folded to form the carton 104. In one or more examples, the alignment machine 230 is further configured to maintain the blank 106 in the proper position while the locking structures 134 are formed in the carton 104, such as to secure the top cover panel 118 and the second cover panel 120 together in the overlapping relationship after being folded.

In one or more examples, the discharge conveyor 232 forms a portion of the fourth station 218. The discharge conveyor 232 may also be referred to as a package discharge conveyor or a fourth conveyor. In one or more examples, the discharge conveyor 232 is in communication with the assembly conveyor 226. The completed package 234 is transferred from the assembly conveyor 226 to the discharge conveyor 232.

In one or more examples, the discharge conveyor 232 is configured to transport the completed package 234 along a discharge path, such as in discrete lines or lanes defined by lane guides, as the completed package 234 enters the discharge conveyor 232 at an upstream end thereof (e.g., from the assembly conveyor 226) and moves along the discharge conveyor 232. In one or more examples, the discharge conveyor 232 is configured to transport the completed package 234 away from the packaging system 100, such as for further packaging and/or storage.

Figure 11:
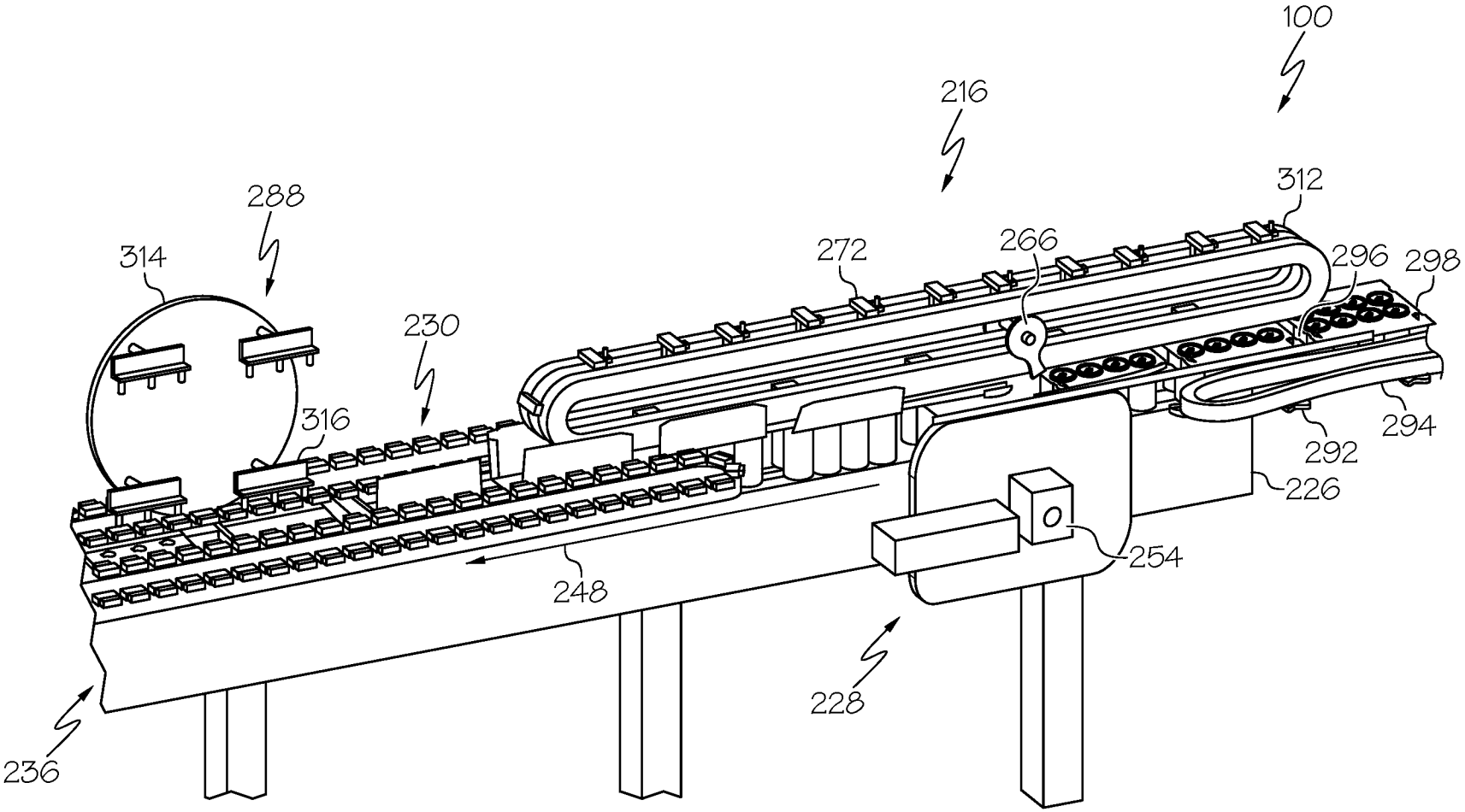
FIG. 11 is a schematic, perspective view of an example of a portion of the packaging system.
Figure 12:
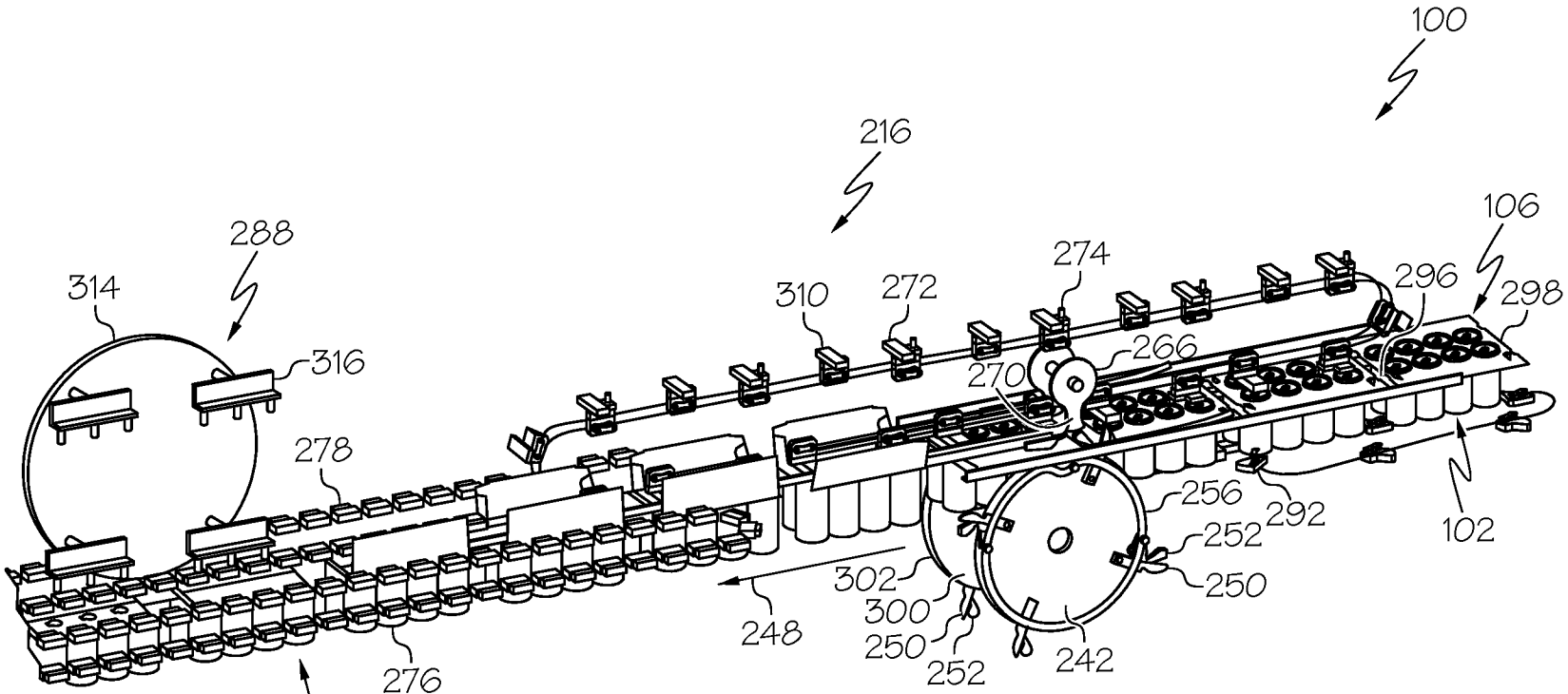
FIG. 12 is a schematic, perspective view of an example of a portion of the packaging system.

Referring now to FIGS. 11 and 12, which schematically illustrate a portion of the packaging system 100, such as the third station 216. In FIG. 12, certain portions of the packaging system 100 (e.g., as shown in FIG. 11) are removed for the purpose of clarity of illustration.

In one or more examples, the blank 106 is in a substantially flat configuration and is applied to the upper ends 246 of the articles 102 when the group of articles 102 and the blank 106 enter the assembly conveyor 226. The first end flap 150 forms a leading end 296 of the blank 106 in the direction of travel (e.g., as shown by directional arrow 248).

The second end flap 152 forms a trailing end 298 of the blank 106 in the direction of travel.

In one or more examples, the packaging system 100 includes a series of side lugs 292 configured to engage each opposing side of the group of articles 102. In one or more examples, the side lugs 292 are configured to suitably position the group of articles 102 on the assembly conveyor 226. In one or more examples, the series of side lugs 292 are configured to move the group of articles 102 along the packaging path on the assembly conveyor 226. In one or more examples, the packaging system 100 includes a side lug drive 294 (e.g., as shown in FIG. 11), such as a continuous chain and drive mechanism, that is configured to move the series of side lugs 292.

In one or more examples, the folding machine 228 is configured to fold the first end panel 142 of the blank 106 relative to the main panel 108 of the blank 106 (e.g., as shown in FIG. 4) as the group of articles 102 and the blank 106, applied to the upper ends 246 of the articles 102, travel along a portion of the packaging path. In one or more examples, the folding machine 228 is configured to fold the second end panel 144 of the blank 106 relative to the main panel 108 of the blank 106 (as shown in FIG. 4) as the group of articles 102 and the blank 106, applied to the upper ends 246 of the articles 102, travel along a portion the packaging path.

In one or more examples, the folding machine 228 is configured to sequentially fold the first end panel 142 and the second end panel 144. For example, the second end panel 144 is folded after the first end panel 142 is folded.

In one or more examples, the folding machine 228 is configured to fold the first end flap 150 of the blank 106 relative to the first end panel 142 (e.g., as shown in FIG. 5) as the group of articles 102 and the blank 106 travel along a portion of the packaging path. In one or more examples, the folding machine 228 is configured to fold the second end flap 152 of the blank 106 relative to the second end panel 144 (e.g., as shown in FIG. 5) as the group of articles 102 and the blank 106 travel along a portion of the packaging path.

In one or more examples, the folding machine 228 is configured to sequentially fold the first end flap 150 and the second end flap 152. For example, the first end flap 150 is folded after the first end panel 142 is folded. The second end flap 152 is folded after the second end panel 144 is folded. The second end flap 152 is folded after the first end flap 150 is folded.

In one or more examples, the folding machine 228 is configured to fold the first side panel 110 of the blank 106 relative to the main panel 108 (e.g., as shown in FIG. 6) as the group of articles 102 and the blank 106 travel along a portion of the packaging path. In one or more examples, the folding machine 228 is configured to fold the second side panel 112 of the blank 106 relative to the main panel 108 (e.g., as shown in FIG. 6) as the group of articles 102 and the blank 106 travel along a portion of the packaging path.

In one or more examples, the first side panel 110 and the second side panel 112 are folded after the first end panel 142, the second end panel 144, the first end flap 150, and the second end flap 152 are folded. In one or more examples, the folding machine 228 is configured to sequentially fold the first side panel 110 and the second side panel 112. In one or more examples, the folding machine 228 is configured to concurrently fold the first side panel 110 and the second side panel 112.

In one or more examples, the folding machine 228 is configured to fold the first cover panel 118 of the blank 106 relative to the first side panel 110 (e.g., as shown in FIG. 8) as the group of articles 102 and the blank 106 travel along a portion of the packaging path. In one or more examples, the folding machine 228 is configured to fold the second cover panel 120 of the blank 106 relative to the second side panel 112 (e.g., as shown in FIG. 7) as the group of articles 102 and the blank 106 travel along a portion of the packaging path.

In one or more examples, the first cover panel 118 and the second cover panel 120 are folded after the first side panel 110 and the second side panel 112 are folded. In one or more examples, the folding machine 228 is configured to fold the first cover panel 118 and the second cover panel 120 sequentially. For example, the first cover panel 118 is folded after the second cover panel 120 is folded to position the first cover panel 118 and the second cover panel 120 is the overlapping relationship (e.g., as shown in FIGS. 7 and 8).

Figure 20:
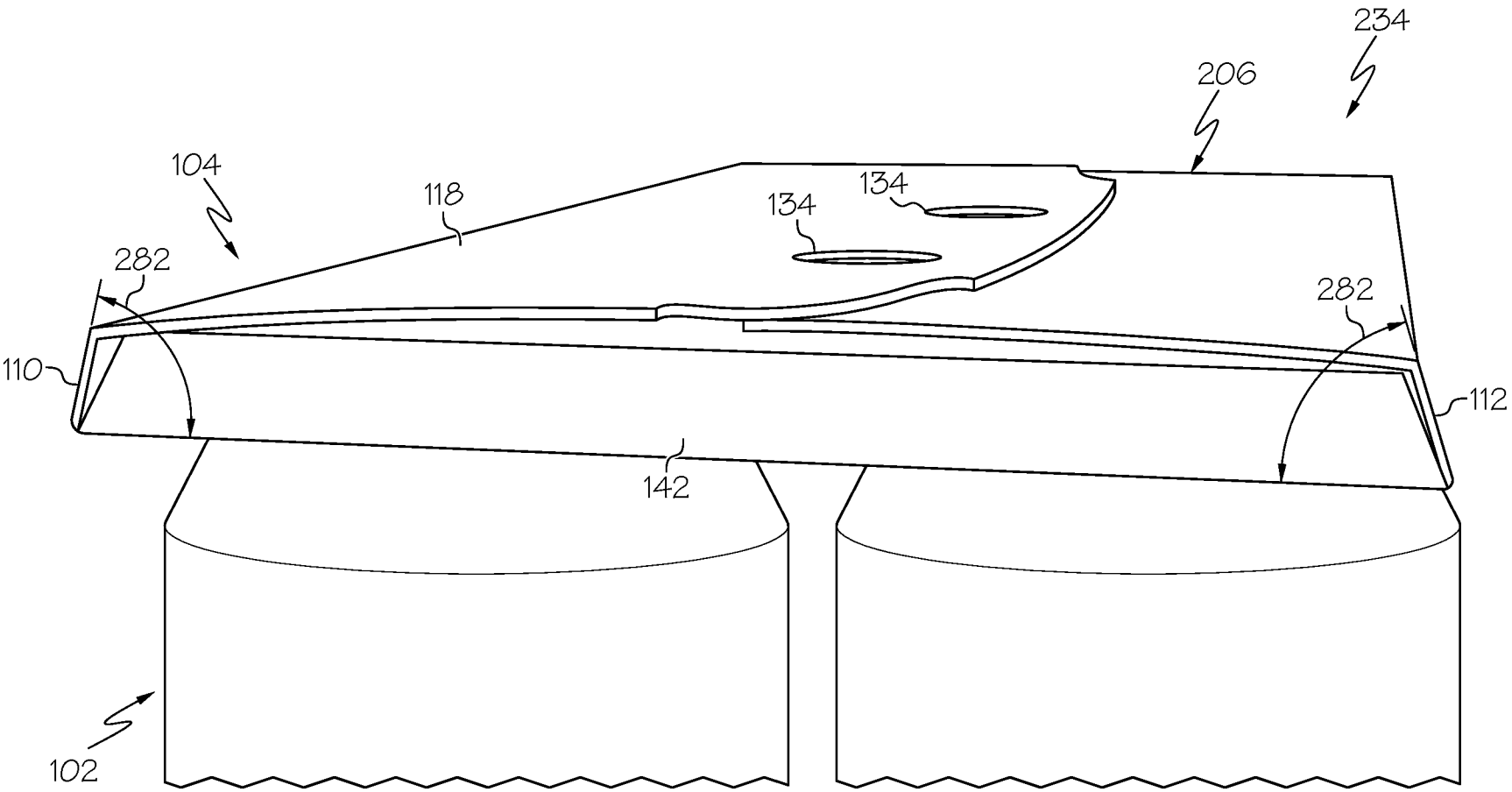
FIG. 20 is a schematic, perspective, end view of an example of the carton.

In one or more examples, the alignment machine 230 is configured to position the first side panel 110 and the second side panel 112 at a predetermined angle 282 (e.g., as shown in FIG. 20) relative to the main panel 108, after the first side panel 110 and the second side panel 112 are folded, as the group of articles 102 and the blank 106 travel along the packaging path and/or while the first cover panel 118 and the second cover panel 120 are being folded.

Referring to FIG. 20, in one or more examples, the alignment machine 230 is configured to position (e.g., fold and/or hold) the first side panel 110 and the second side panel 112 at an orientation that is approximately perpendicular to the main panel 108. For example, the predetermined angle 282 is approximately 90-degrees. In one or more examples, the alignment machine 230 is configured to position (e.g., fold and/or hold) the first side panel 110 and the second side panel 112 at an oblique angle relative to the main panel 108. For example, the predetermined angle 282 ranges from approximately 45-degrees to approximately 90-degrees, such as from approximately 60-degrees to approximately 90-degrees.

Referring now to FIGS. 13-16, which schematically illustrate a portion of the packaging system 100 and, more particularly, a portion of the folding machine 228. In FIGS. 13-16, certain portions of the packaging system 100 (e.g., as shown in FIG. 11) are removed for the purpose of clarity of illustration.

In one or more examples, the folding machine 228 includes a lower folding wheel 242. The lower folding wheel 242 is configured to rotate about a lower rotational axis 244. In one or more examples, the lower rotational axis 244 is a horizontal axis. In one or more examples, the lower rotational axis 244 is at least approximately, such as substantially, perpendicular to the direction of travel of the articles 102 and the blank 106 along the packaging path.

In one or more examples, the folding machine 228 includes a first lower folding arm 250 and a second lower folding arm 252. The first lower folding arm 250 projects radially from the lower folding wheel 242. The second lower folding arm 252 projects radially from the lower folding wheel 242.

In one or more examples, the folding machine 228 includes a lower rotary drive 254 (e.g., as shown in FIG. 12). The lower rotary drive 254 is configured to rotate the lower folding wheel 242 about the lower rotational axis 244 in a direction of rotation (e.g., as shown by directional arrow 290 in FIGS. 13 and 14). In one or more examples, the lower rotary drive 254 is connected to the lower folding wheel 242 by a drive shaft (not shown). The lower rotary drive 254 includes any suitable rotary drive mechanism, such as a servo motor.

In one or more examples, the first lower folding arm 250 is configured to fold the first end panel 142 upward to an orientation that is approximately perpendicular to the main panel 108 of the blank 106 as the lower folding wheel 242 rotates and the group of articles 102 and the blank 106 pass over the lower folding wheel 242. Rotation of the lower folding wheel 242 rotates the first lower folding arm 250 upward into engagement the blank 106 as the leading end 296 of the blank 106 approaches the lower folding wheel 242. Further rotation of the lower folding wheel 242 rotates the first lower folding arm 250 upward and forward to urge the first end panel 142 upwardly toward a folded position (e.g., to fold the first end panel 142 out of the plane of the main panel 108 and toward the main panel 108) as the leading end 296 of the blank 106 passes over the lower folding wheel 242. Further rotation of the lower folding wheel 242 rotates the first lower folding arm 250 downward and forward out of engagement from the blank 106 as the leading end 296 of the blank 106 departs the lower folding wheel 242.

In one or more examples, the first lower folding arm 250 is configured to engage the first end panel 142 from below to fold the first end panel 142 upward relative to the main panel 108 into the folded position. In one or more examples, the first lower folding arm 250 is configured to engage the first end flap 150 from below to fold the first end panel 142 upward relative to the main panel 108 into the folded position.

In one or more examples, the second lower folding arm 252 is configured to fold the second end panel 144 upward to an orientation that is approximately perpendicular to the main panel 108 as the lower folding wheel 242 rotates and the group of articles 102 and the blank 106 pass over the lower folding wheel 242. Rotation of the lower folding wheel 242 rotates the second lower folding arm 252 upward into engagement the blank 106 as the trailing end 298 of the blank 106 approaches the lower folding wheel 242. Further rotation of the lower folding wheel 242 rotates the second lower folding arm 252 upward and forward to urge the second end panel 144 toward a folded position (e.g., to fold the second end panel 144 out of the plane of the main panel 108 and toward the main panel 108) as the trailing end 298 of the blank 106 passes over the lower folding wheel 242. Further rotation of the lower folding wheel 242 rotates the second lower folding arm 252 upward and rearward out of engagement from the blank 106 as the trailing end 298 of the blank 106 departs the lower folding wheel 242. Further rotation of the lower folding wheel 242 rotates the second lower folding arm 252 downward and forward away from the blank 106.

In one or more examples, the second lower folding arm 252 is configured to engage the second end panel 144 from below to fold the second end panel 144 upward relative to the main panel 108 into the folded position. In one or more examples, the second lower folding arm 252 is configured to engage the second end flap 152 from below to fold the second end panel 144 upward relative to the main panel 108 into the folded position.

In one or more examples, the second lower folding arm 252 is configured to fold the second end flap 152 in the direction of travel of the group of articles 102 and the blank 106 to an orientation that is approximately perpendicular to the second end panel 144 as the lower folding wheel 242 rotates and the group of articles 102 and the blank 106 pass over the lower folding wheel 242. With the second lower folding arm 252 engaged with the blank 106 to urge the second end panel 144 toward the folded position, further rotation of the lower folding wheel 242 rotates the second lower folding arm 252 downward and forward to engage and urge the second end flap 152 toward a folded position (e.g., to fold the second end flap 152 out of the plane of the second end panel 144 and toward the main panel 108) as the trailing end 298 of the blank 106 passes over the lower folding wheel 242.

In one or more examples, the second lower folding arm 252 is configured to engage the second end flap 152 from behind and/or above to fold the second end flap 152 downward relative to the second end panel 144 into the folded position.

In one or more examples, the first lower folding arm 250 and the second lower folding arm 252 are angularly displaced from each other. In one or more examples, the angular displacement between the first lower folding arm 250 and the second lower folding arm 252 is selected such that such that the first lower folding arm 250 and the second lower folding arm 252 suitably engage the blank 106 to fold the first end panel 142 and the second end panel 144 into the folded positions as the group of articles 102 and the blank 106 pass over the lower folding wheel 242.

In one or more examples, the angular displacement between the first lower folding arm 250 and the second lower folding arm 252 is adjustable to account for various packaging parameters, such as, but not limited to, a rotational speed of the lower folding wheel 242, a flow rate of the group of articles 102 and the blank 106, the arrangement of the articles 102 in the group, dimensions of the blank 106, and the like. For example, at least one of the first lower folding arm 250 and/or the second lower folding arm 252 is releasably coupled to the lower folding wheel 242.

Figure 15:
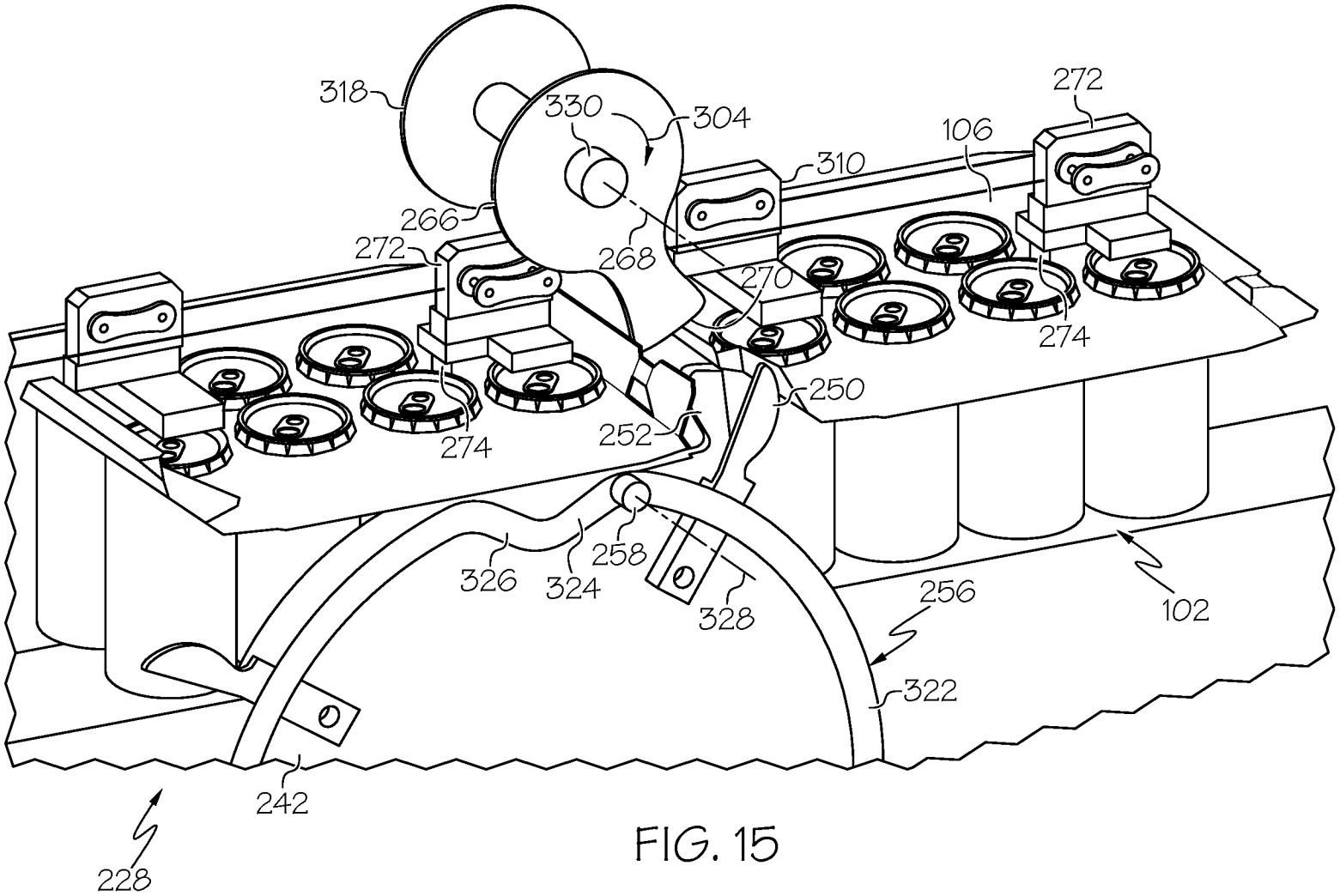
FIG. 15 is a schematic, perspective view of an example of a portion of the packaging system.

In one or more examples, the first lower folding arm 250 is fixed to the lower folding wheel 242 such that the first lower folding arm 250 is does not move relative to the lower folding wheel 242 as the lower folding wheel rotates. In one or more examples, the second lower folding arm 252 is configured to pivot about a pivot axis 328 (e.g., as shown in FIG. 15) relative to the lower folding wheel 242. In one or more examples, the pivot axis 328 is a horizontal axis. In one or more examples, the pivot axis 328 is at least approximately, such as substantially, perpendicular to the direction of travel of the articles 102 and the blank 106 along the packaging path. In one or more examples, the pivot axis 328 is parallel to the lower rotational axis 244. In one or more examples, the second lower folding arm 252 is radially movable relative to the lower folding wheel 242. Pivotal and radial movements of the second lower folding arm 252 enable the second lower folding arm 252 to sequentially fold the second end panel 144 and the second end flap 152 into the folded positions in one rotation of the lower folding wheel 242.

In one or more examples, the folding machine 228 further includes a cam track 256. The cam track 256 is located adjacent to the lower folding wheel 242. The folding machine 228 also includes a cam follower 258. The cam follower 258 is coupled to the second lower folding arm 252 and is engaged with the cam track 256. In one or more examples, the pivot axis 328 extends through the cam follower 258 and the second lower folding arm 252. The second lower folding arm 252 is configured to pivot about the pivot axis 328 and radially move relative to the lower folding wheel 242 as the cam follower 258 moves along the cam track 256.

In one or more examples, the cam track 256 includes substantially circular section 322, a downward sloping section 324, and an upward sloping section 326 (e.g., as shown in FIG. 15). As the cam follower 258 moves along the circular section 322, the second lower folding arm 252 is rotated upward and forward into engagement with the blank 106, such as the second end panel 144, the second end flap 152, the third anchor flap 162, and/or the fourth anchor flap 164. As the cam follower 258 moves along the downward sloping section 324, the second lower folding arm 252 moves downward relative to the blank 106 (e.g., radially inward relative to the lower folding wheel 242) and pivots forward to fold the second end panel 144 and the second end flap 152 in the folded positions. As the cam follower 258 moves along the upward sloping section 326, the second lower folding arm 252 moves upward relative to the blank 106 (e.g., radially outward relative to the lower folding wheel 242) and pivots rearward out of engagement with the blank 106.

In one or more examples, the first lower folding arm 250 includes a substantially straight body. The body of the first lower folding arm 250 includes an engaging edge configured to contact the blank 106. In one or more examples, the engaging edge of the first lower folding arm 250 is curved.

In one or more examples, the second lower folding arm 252 includes a first body portion that is coupled to the cam follower 258 and a second body portion that extends from the first body portion at an angle, such as an oblique angle or approximately perpendicular to the first body portion. The angular relationship between the first body portion and the second body portion of the second lower folding arm 252 enables the second lower folding arm 252 to hook over the second end panel 144, in the folded position, to fold the second end flap 152 into the folded position. The second body portion of the second lower folding arm 252 includes an engaging edge configured to contact the blank 106. In one or more examples, the engaging edge of the second lower folding arm 252 is curved. The In one or more examples, a plurality of first lower folding arms 250 and a plurality of second lower folding arms 252 project radially from the lower folding wheel 242. Each one of the plurality of first lower folding arms 250 is equally angularly displaced from an adjacent one of the plurality of first lower folding arms 250. Each one of the plurality of second lower folding arms 252 is equally angularly displaced from an adjacent one of the plurality of second lower folding arms 252.

In one or more examples, the rotational speed of the lower folding wheel 242 is synchronized with the flow rate of the group of articles 102 and the blank 106 such that the first lower folding arm 250 and the second lower folding arm 252 suitably engage the blank 106 to fold the first end panel 142 and the second end panel 144 into the folded positions as the group of articles 102 and the blank 106 pass over the lower folding wheel 242.

In one or more examples, the folding machine 228 includes a second lower folding wheel 300 (e.g., as shown in FIG. 12). In these examples, the lower folding wheel 242 may be referred to as a first lower folding wheel. In one or more examples, the second lower folding wheel 300 is substantially the same as the lower folding wheel 242.

In one or more examples, the second lower folding wheel 300 is configured to rotate about the lower rotational axis 244. In one or more examples, the lower rotary drive 254 (e.g., as shown in FIG. 11) is configured to rotate the lower folding wheel 242 about the lower rotational axis 244 in the direction of rotation. In one or more examples, the folding machine 228 includes a second lower rotary drive (not shown) that is dedicated to the second lower folding wheel 300.

In one or more examples, the folding machine 228 includes the first lower folding arm 250 that projects radially from the second lower folding wheel 300 and the second lower folding arm 252 that projects radially from the second lower folding wheel 300. In one or more examples, the first lower folding arm 250 and the second lower folding arm 252 of the second lower folding wheel 300 are substantially the same as the first lower folding arm 250 and the second lower folding arm 252 of the lower folding wheel 242.

In one or more examples, the lower folding wheel 242 is located at a first side of the assembly conveyor 226 and the second lower folding wheel 300 is located at a second side of the assembly conveyor 226, opposite the lower folding wheel 242 such that the group of articles 102 and the blank 106 pass between the lower folding wheel 242 and the second lower folding wheel 300 as the group of articles 102 and the blank 106 travel along the packaging path.

In one or more examples, the first lower folding arms 250 of the lower folding wheel 242 and the second lower folding wheel 300 are configured to engage the first end panel 142 from below to fold the first end panel 142 upward relative to the main panel 108 into the folded position. In one or more examples, the first lower folding arms 250 of the lower folding wheel 242 and the second lower folding wheel 300 are configured to engage the first end flap 150 from below to fold the first end panel 142 upward relative to the main panel 108 into the folded position. In one or more examples, the first lower folding arm 250 of the lower folding wheel 242 is configured to engage the second anchor flap 160 from below and the first lower folding arm 250 the second lower folding wheel 300 is configured to engage the second anchor flap 158 from below to fold the first end panel 142 upward relative to the main panel 108 into the folded position.

In one or more examples, the second lower folding arms 252 of the lower folding wheel 242 and the second lower folding wheel 300 are configured to engage the second end panel 144 from below to fold the second end panel 144 upward relative to the main panel 108 into the folded position. In one or more examples, the second lower folding arms 252 of the lower folding wheel 242 and the second lower folding wheel 300 are configured to engage the second end flap 152 from below to fold the second end panel 144 upward relative to the main panel 108 into the folded position. In one or more examples, the second lower folding arm 252 of the lower folding wheel 242 is configured to engage the fourth anchor flap 164 from below and the second lower folding arm 252 the second lower folding wheel 300 is configured to engage the third anchor flap 162 from below to fold the second end panel 144 upward relative to the main panel 108 into the folded position.

In one or more examples, the second lower folding arms 252 of the lower folding wheel 242 and the second lower folding wheel 300 are configured to engage the second end flap 152 from behind and/or above to fold the second end flap 152 downward relative to the second end panel 144 into the folded position. In one or more examples, the second lower folding arm 252 of the lower folding wheel 242 is configured to engage the fourth anchor flap 164 from behind and/or above and the second lower folding arm 252 the second lower folding wheel 300 is configured to engage the third anchor flap 162 from behind and/or above to fold the second end flap 152 downward relative to the second end panel 144 into the folded position.

In one or more examples, the folding machine 228 further includes a second cam track 302 (e.g., as shown in FIG. 12). The second cam track 256 is located adjacent to the second lower folding wheel 300. The folding machine 228 also includes a second cam follower (not shown) that is coupled to the second lower folding arm 252 of the second lower folding wheel 300 and that is engaged with the second cam track 256. In one or more examples, the second cam track 302 and the second cam follower associated with the second lower folding wheel 300 are substantially the same as the cam track 256 and the cam follower 258 associated with the lower folding wheel 242.

In one or more examples, a second plurality of first lower folding arms 250 and a second plurality of second lower folding arms 252 project radially from the second lower folding wheel 300. Each one of the second plurality of first lower folding arms 250 is equally angularly displaced from an adjacent one of the second plurality of first lower folding arms 250. Each one of the second plurality of second lower folding arms 252 is equally angularly displaced from an adjacent one of the second plurality of second lower folding arms 252.

In one or more examples, a rotational speed of the second lower folding wheel 300 is synchronized with the rotational speed of the lower folding wheel 242 and the flow rate of the group of articles 102 and the blank 106 such that the first lower folding arms 250 and the second lower folding arms 252 of the lower folding wheel 242 and the second lower folding wheel 300 suitably engage the blank 106 to fold the first end panel 142 and the second end panel 144 into the folded positions as the group of articles 102 and the blank 106 pass over and between the lower folding wheel 242 and the second lower folding wheel 300.

Figure 13:
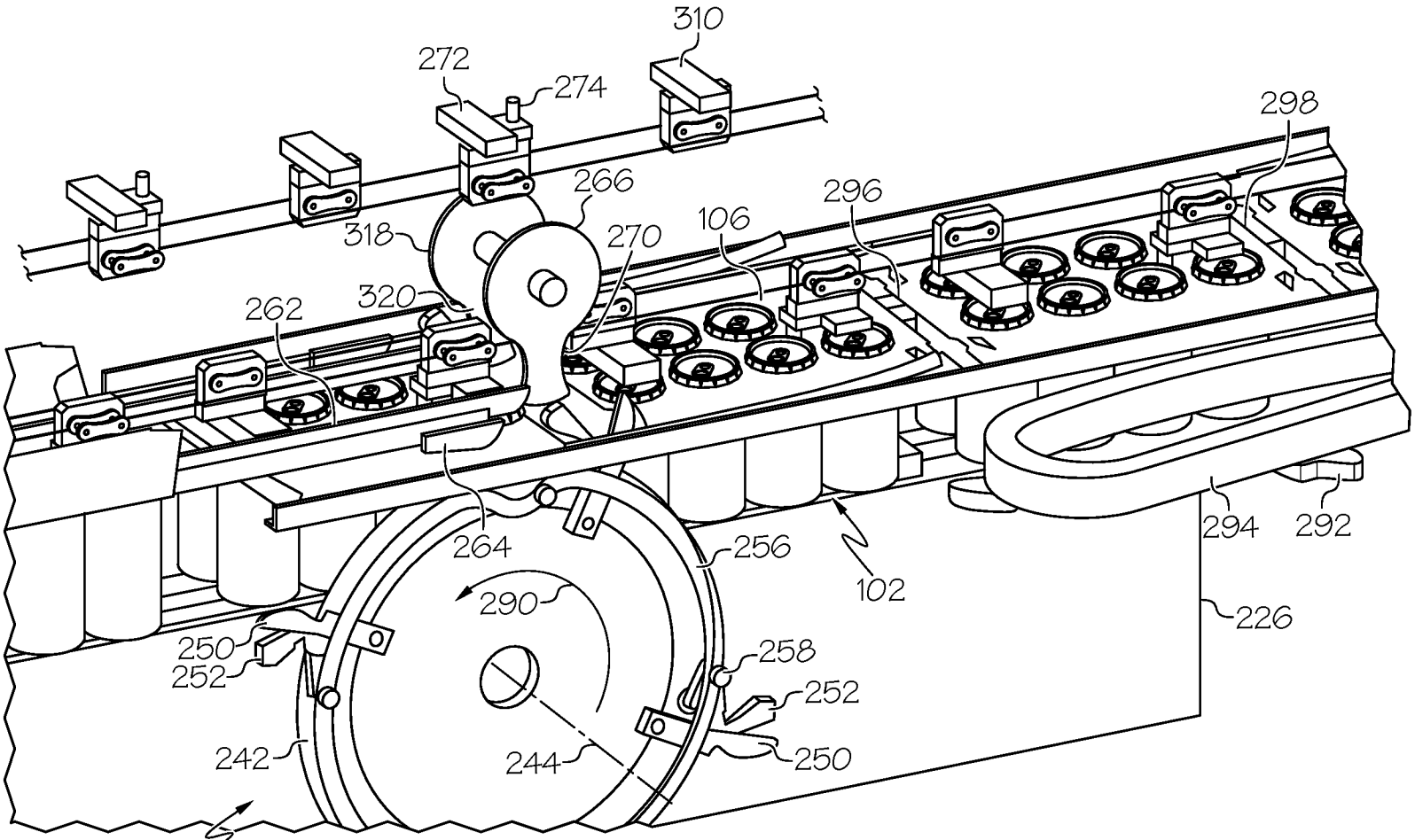
FIG. 13 is a schematic, perspective view of an example of a portion of the packaging system.
Figure 14:
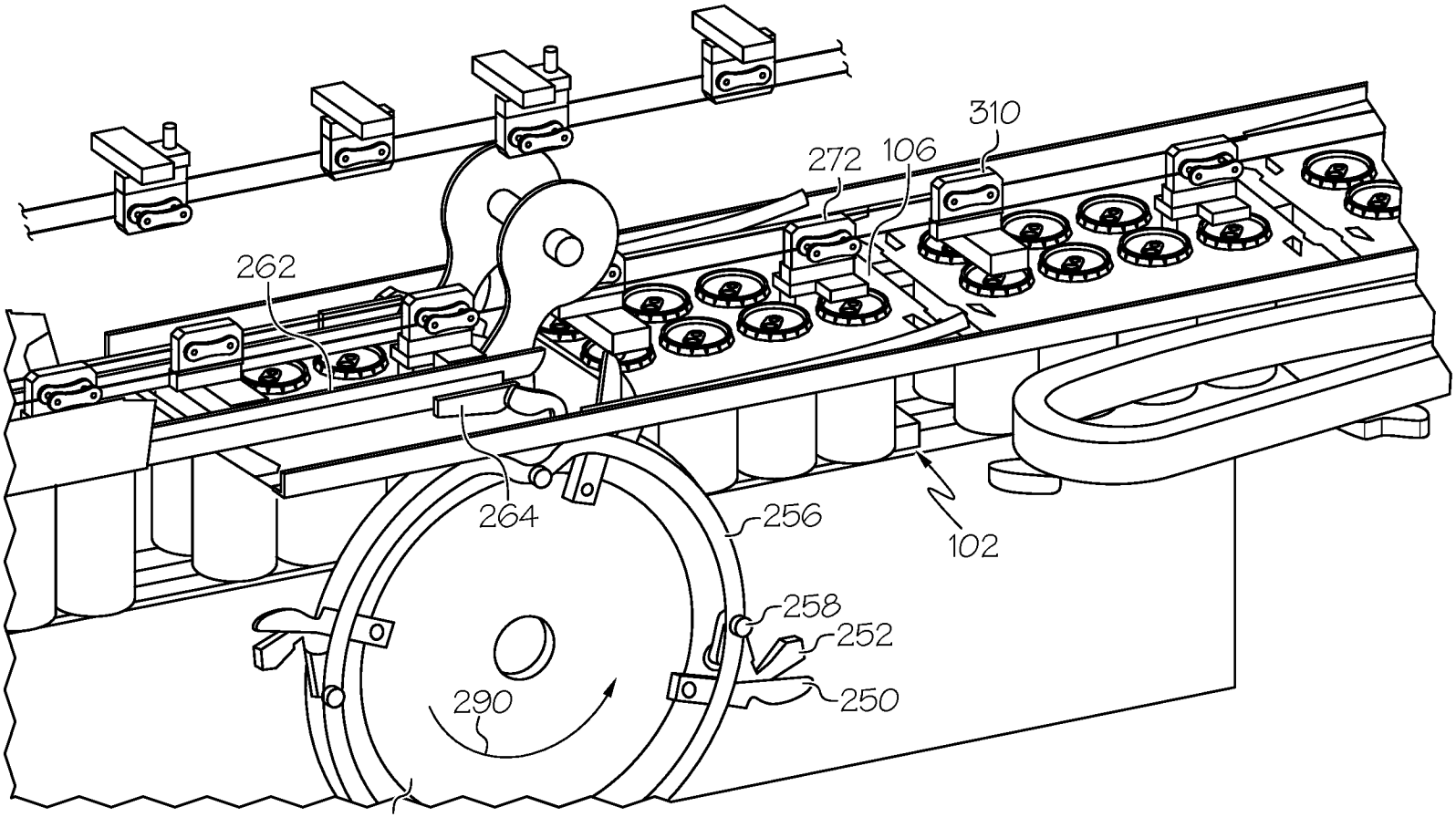
FIG. 14 is a schematic, perspective view of an example of a portion of the packaging system.
Figure 16:
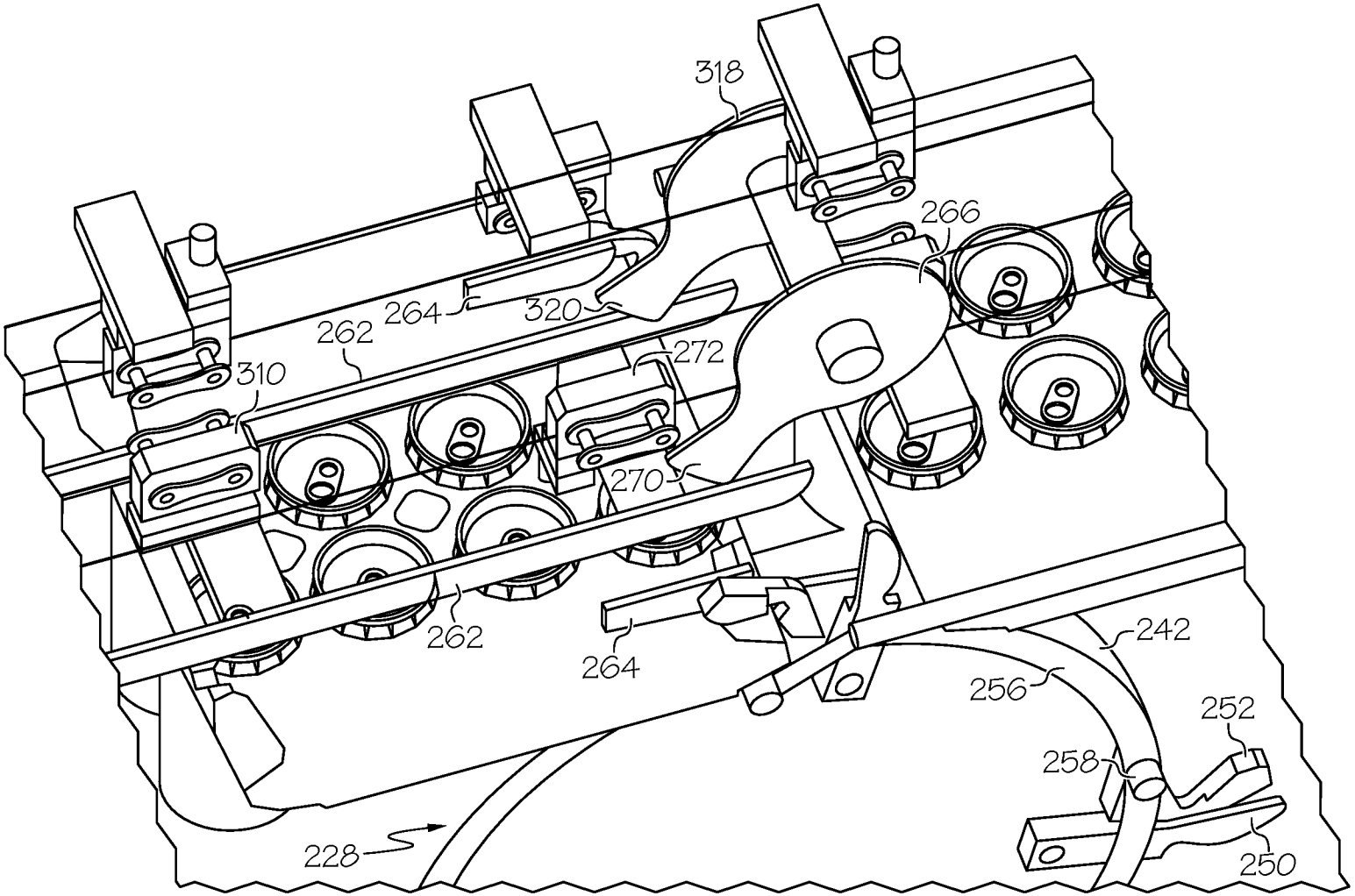
FIG. 16 is a schematic, perspective view of an example of a portion of the packaging system.

In one or more examples, the folding machine 228 includes an end-flap fold guide 262, such as a pair of end-fold guides 262 (e.g., as shown in FIGS. 13, 14 and 16). In one or more examples, the end-flap fold guide 262 is located above the lower folding wheel 242. In one or more examples, the end-flap fold guide 262 extends along at least a portion of the packaging path. The end-flap fold guide 262 is configured to fold the first end flap 150 opposite to the direction of travel of the group of articles 102 and the blank 106 to an orientation that is approximately perpendicular to the first end panel 142 as the blank 106 travels under the end-flap fold guide 262.

In one or more examples, the end-flap fold guide 262 (e.g., each one of the pair of end-flap fold guides 262) includes an engaging end extending in an upstream direction of the packaging path. In one or more examples, the end-flap fold guide 262 includes a plow, a turning plate, a turning rod, or other mechanism configured to passively urge the first end flap 150 into a folded position as the blank 106 travels under the end-flap fold guide 262. The end-flap fold guide 262 includes an engaging edge configured to contact the blank 106. In one or more examples, the engaging end of the end-flap fold guide 262 is curved.

In one or more examples, the end-flap fold guide 262 is configured to engage the first end flap 150 as the blank 106 passes under the end-flap fold guide 262. In one or more examples, the first lower folding arm 250 is configured to hold the first end flap 150 in an upwardly folded orientation such that the end-flap fold guide 262 can further fold the first end flap 150 into the folded position.

In one or more examples, the end-flap fold guide 262 is positioned between the lower folding wheel 242 and the second lower folding wheel 300.

In one or more examples, the folding machine 228 includes an anchor-flap fold guide 264, such as a pair of anchor-flap guides 264 (e.g., as shown in FIGS. 13, 14 and 16). In one or more examples, the anchor-flap fold guide 264 is located above the lower folding wheel 242 and below the end-flap fold guide 262. In one or more examples, the anchor-flap fold guide 264 extends along at least a portion of the packaging path.

In one or more examples, the anchor-flap fold guide 264 is configured to fold the first anchor flap 158 and the second anchor flap 160 of the blank 106 opposite to the direction of travel of the group of articles 102 and the blank 106 to an orientation that is approximately parallel to the main panel 108 as the blank 106 travels under the anchor-flap fold guide 264. In one or more examples, the anchor-flap fold guide 264 is configured to fold the first anchor flap 158 and the second anchor flap 160 into a face-to-face relationship with a respective one of the first cover panel 118 and the second cover panel 120 to which they are hinged.

In one or more examples, the anchor-flap fold guide 264 is configured to fold the third anchor flap 162 and the fourth anchor flap 164 of the blank 106 in the direction of travel of the group of articles 102 and the blank 106 to an orientation that is approximately parallel to the main panel 108 as the blank 106 travels under the anchor-flap fold guide 264. In one or more examples, the anchor-flap fold guide 264 is configured to fold the third anchor flap 162 and the fourth anchor flap 164 into a face-to-face relationship with a respective one of the first cover panel 118 and the second cover panel 120 to which they are hinged.

In one or more examples, the anchor-flap fold guide 264 (e.g., each one of the pair of anchor-flap fold guides 264) includes an engaging end extending in an upstream direction of the packaging path. In one or more examples, the anchor-flap fold guide 264 includes a plow, a turning plate, a turning rod, or other mechanism configured to passively urge the anchor flaps 158, 160, 162, 164 into folded positions as the blank 106 travels under the anchor-flap fold guide 264. The anchor-flap fold guide 264 includes an engaging edge configured to contact the blank 106. In one or more examples, the engaging end of the anchor-flap fold guide 264 is curved.

In one or more examples, the anchor-flap fold guide 264 is configured to engage the first anchor flap 158 and the second anchor flap 160 as the blank 106 passes under the anchor-flap fold guide 264. In one or more examples, the anchor-flap fold guide 264 is configured to engage the third anchor flap 162 and the fourth anchor flap 164 as the blank 106 passes under the anchor-flap fold guide 264. In one or more examples, second lower folding arm 252 is configured to hold the second end flap 152 and, thus, the third anchor flap 162 and the fourth anchor flap 164 in a downwardly folded orientation such that the anchor-flap guide 264 can further fold the third anchor flap 162 and the fourth anchor flap 164 into the folded position.

In one or more examples, the folding machine 228 includes an upper folding wheel 266. In one or more examples, the upper folding wheel 266 is located above the lower folding wheel 242. The upper folding wheel 266 is configured to rotate about an upper rotational axis 268 (e.g., as shown in FIG. 15). In one or more examples, the upper rotational axis 268 is a horizontal axis. In one or more examples, the upper rotational axis 268 is at least approximately, such as substantially, perpendicular to the direction of travel of the articles 102 and the blank 106 along the packaging path. In one or more examples, the upper rotational axis 268 is parallel to the lower rotational axis 244.

In one or more examples, the folding machine 228 further includes an upper folding arm 270. The upper folding arm 270 projects radially from the upper folding wheel 266. In one or more examples, the plurality of upper folding arms 270 project radially from the upper folding wheel 266.

The folding machine 228 also includes an upper rotary drive 330. The upper rotary drive 330 is configured to rotate the upper folding wheel 266 about the upper rotational axis 268 in a direction of rotation (e.g., as shown by directional arrow 304 in FIG. 15). Additionally, or alternatively, the upper rotary drive 330 is configured to rotate the upper folding wheel 266 about the upper rotational axis 268 in a direction of rotation (e.g., opposite to the directional arrow 304 in FIG. 15). In one or more examples, the upper rotary drive 330 is connected to the upper folding wheel 266 by a drive shaft (not shown). The upper rotary drive 330 includes any suitable rotary drive mechanism, such as a servo motor.

In one or more examples, the rotational speed of the upper folding wheel 266 is constant. In one or more examples, the rotational speed of the upper folding wheel 266 is variable, such as variably controlled using a cam profile.

In one or more examples, the upper folding arm 270 is configured to assist the lower folding wheel 242, and the second lower folding wheel 300 when present, in folding the second end panel 144 and/or the second end flap 152 into folded positions as the group of articles 102 and the blank 106 travel along a portion of the packaging path. In one or more examples, the rotational speed of the upper folding wheel 266 is synchronized with the flow rate of the group of articles 102 and the blank 106 such that the upper folding arm 270 suitably engages the blank 106 to fold the second end panel 144 and/or the second end flap 152 into the folded positions as the group of articles 102 and the blank 106 pass under the upper folding wheel 266.

In one or more examples, the upper folding arm 270 is configured to fold the second end panel 144 upward to the orientation that is approximately perpendicular to the main panel 108 as the upper folding wheel 266 rotates (e.g., in the direction of arrow 304) and the group of articles 102 and the blank 106 pass under the upper folding wheel 266. In one or more examples, the upper folding arm 270 is configured to fold the second end flap 152 in the direction of travel of the group of articles 102 and the blank 106 to the orientation that is approximately perpendicular to the second end panel 144 as the upper folding wheel 266 rotates (e.g., in the direction of arrow 304) and the group of articles 102 and the blank 106 pass under the upper folding wheel 266.

In one or more examples, the upper folding arm 270 is configured to engage the second end panel 144 from behind and/or above to fold the second end panel 144 upward relative to the main panel 108 into the folded position. In one or more examples, the upper folding arm 270 is configured to engage the second end flap 152 from behind and/or above to fold the second end flap 152 downward relative to the second end panel 144 into the folded position.

In one or more examples, the upper folding arm 270 is configured to assist the lower folding wheel 242, and the second lower folding wheel 300 when present, in folding the first end panel 142 and/or the first end flap 150 into folded positions as the group of articles 102 and the blank 106 travel along a portion of the packaging path. In one or more examples, the rotational speed of the upper folding wheel 266 is synchronized with the flow rate of the group of articles 102 and the blank 106 such that the upper folding arm 270 suitably engages the blank 106 to fold the first end panel 142 and/or the first end flap 150 into the folded positions as the group of articles 102 and the blank 106 pass under the upper folding wheel 266.

In one or more examples, the upper folding arm 270 is configured to fold the first end panel 142 upward to the orientation that is approximately perpendicular to the main panel 108 as the upper folding wheel 266 rotates (e.g., in a direction opposite to arrow 304) and the group of articles 102 and the blank 106 pass under the upper folding wheel 266. In one or more examples, the upper folding arm 270 is configured to fold the first end flap 150 opposite to the direction of travel of the group of articles 102 and the blank 106 to the orientation that is approximately perpendicular to the second end panel 144 as the upper folding wheel 266 rotates (e.g., in a direction opposite to arrow 304) and the group of articles 102 and the blank 106 pass under the upper folding wheel 266.

In one or more examples, the upper folding arm 270 is configured to engage the first end panel 142 from the front and/or above to fold the first end panel 142 upward relative to the main panel 108 into the folded position. In one or more examples, the upper folding arm 270 is configured to engage the first end flap 150 from the front and/or above to fold the first end flap 150 downward relative to the second end panel 144 into the folded position.

In one or more examples, the folding machine 228 includes a second upper folding wheel 318 and a second upper folding arm 320 projecting radially from the second upper folding wheel 318. The second upper folding wheel 318 is substantially the same as the upper folding wheel 266. The second upper folding arm 320 is substantially the same of the upper folding arm 270.

In one or more examples, the packaging system 100 includes an upper lug 272. The upper lug 272 is configured to engage the upper end 246 of the articles 102. The upper lug 272 is configured to press against the articles 102 from above and to counter any movement to the articles 102 and/or the blank 106 due to engagement with the folding machine 228 during folding of the blank 106.

In one or more examples, the packaging system 100 includes a second upper lug 310. The second upper lug 310 is configured to engage the upper end 246 of the articles 102 in a spaced away relationship from the upper lug 272. The second upper lug 310 is configured to press against the articles 102 from above and to counter any movement to the articles 102 and/or the blank 106 due to engagement with the folding machine 228 during folding of the blank 106.

In one or more examples, the upper lug 272 is configured to engage the articles 102 proximate the trailing end 298 of the blank 106 and the second upper lug 310 is configured to engage the articles 102 proximate the leading end 296 of the blank 106. In one or more examples, the spaced apart distance (e.g., linear displacement) between the upper lug 272 and the second upper lug 310 is adjustable to account for various different sizes and/or configurations of the group of articles 102 and the blank 106.

In one or more examples, the packaging system 100 includes a post 274 projecting downwardly from the upper lug 272. Optionally, the second upper lug 310 additionally, or alternately, includes the post 274 projecting therefrom. In one or more examples, the post 274 is configured to be at least partially inserted through the handle aperture 132 formed in the main panel 108. The post 274 is configured to index the blank 106 during folding.

In one or more examples, the folding machine 228 includes a side-panel fold guide, such as a pair of side-panel fold guides (not shown). The side-panel fold guide is configured to fold the first side panel 110 relative to the main panel 108 into a folded position and to fold the second side panel 112 relative to the main panel 108 into a folded position. The side-panel fold guide includes, or takes the form of, any suitable panel folding mechanism, such as a plow, a turning plate, a turning rod (e.g., extending downstream) or other mechanism configured to urge (e.g., upwardly fold), passively or actively, the first side panel 110 and the second side panel 112 into folded positions relative to the main panel 108 as the group of articles 102 and the blank 106 travel along a portion of the packaging path.

In one or more examples, the folding machine 228 includes a cover-panel fold guide, such as a pair of cover-panel fold guides (not shown). The cover-panel fold guide is configured to fold the first cover panel 118 relative to the first side panel 110 into a folded position and to fold the second cover panel 120 relative to the second side panel 112 into a folded position. The cover-panel fold guide includes, or takes the form of, any suitable panel folding mechanism, such as a plow, a turning plate, a turning rod (e.g., extending downstream) or other mechanism configured to urge (e.g., downward fold), passively or actively, the first cover panel 118 and the second cover panel 120 as the group of articles 102 and the blank 106 travel along a portion of the packaging path.

Figure 17:
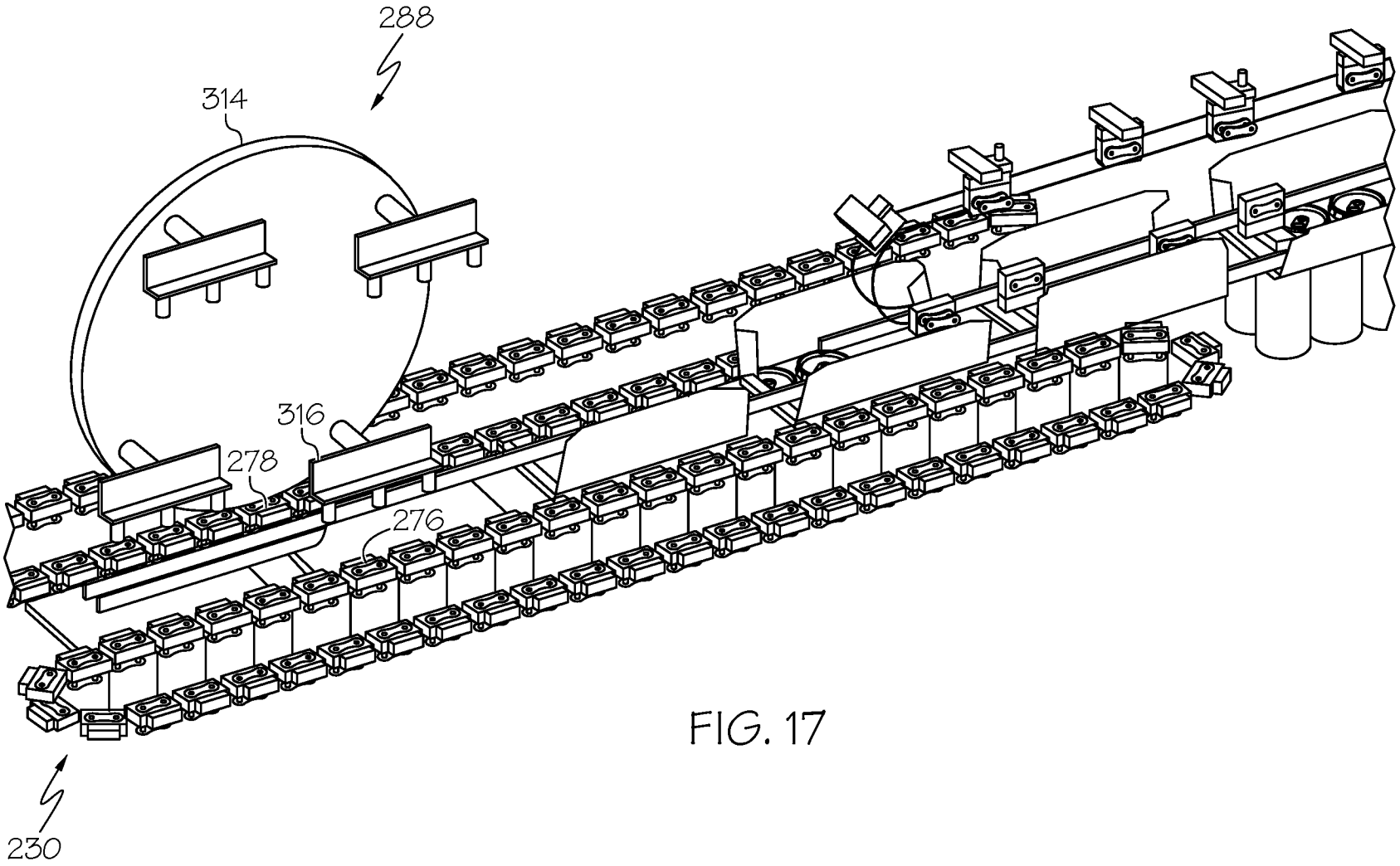
FIG. 17 is a schematic, perspective view of an example of a portion of the packaging system.
Figure 18:
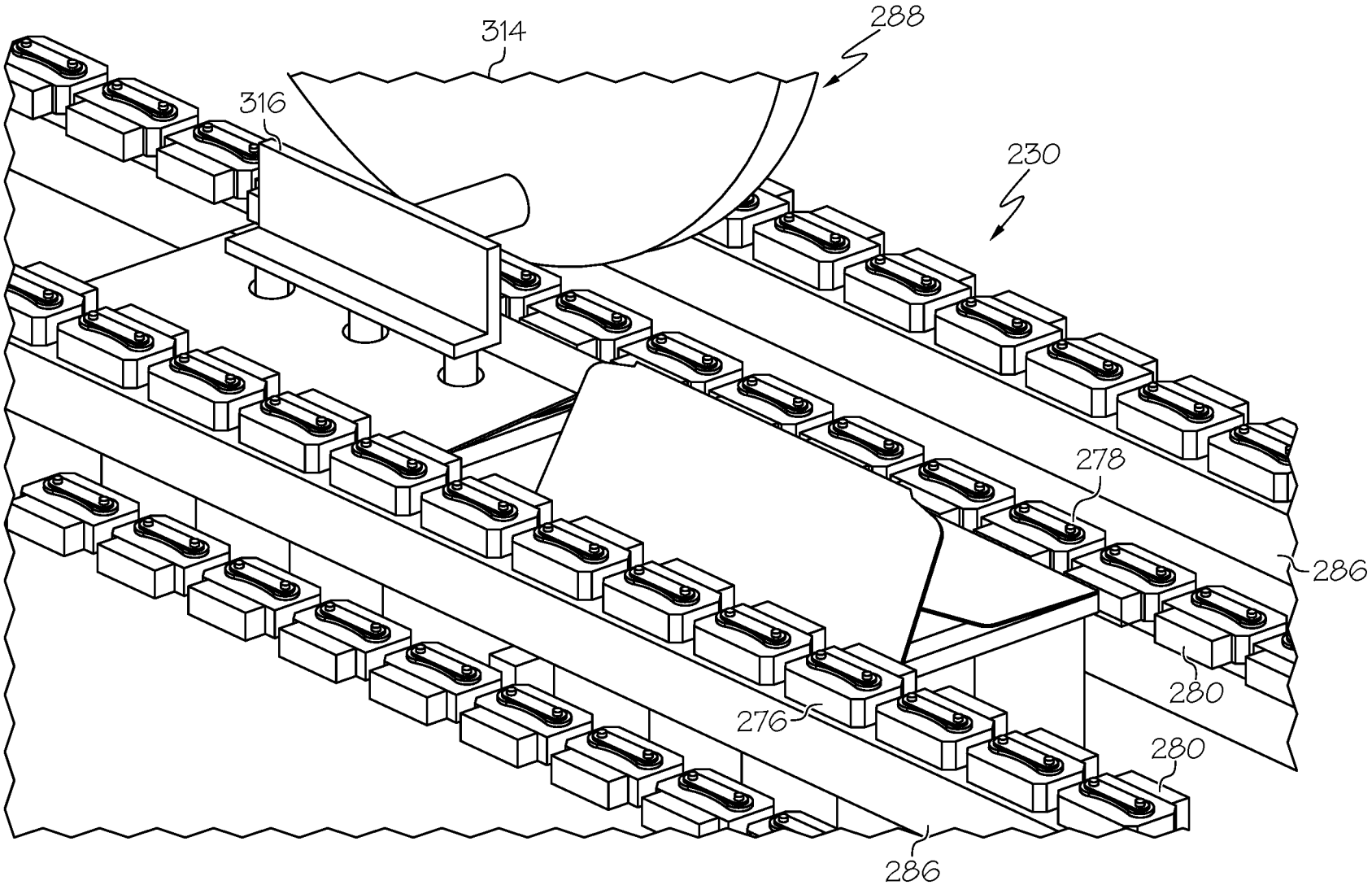
FIG. 18 is a schematic, perspective view of an example of a portion of the packaging system.
Figure 19:
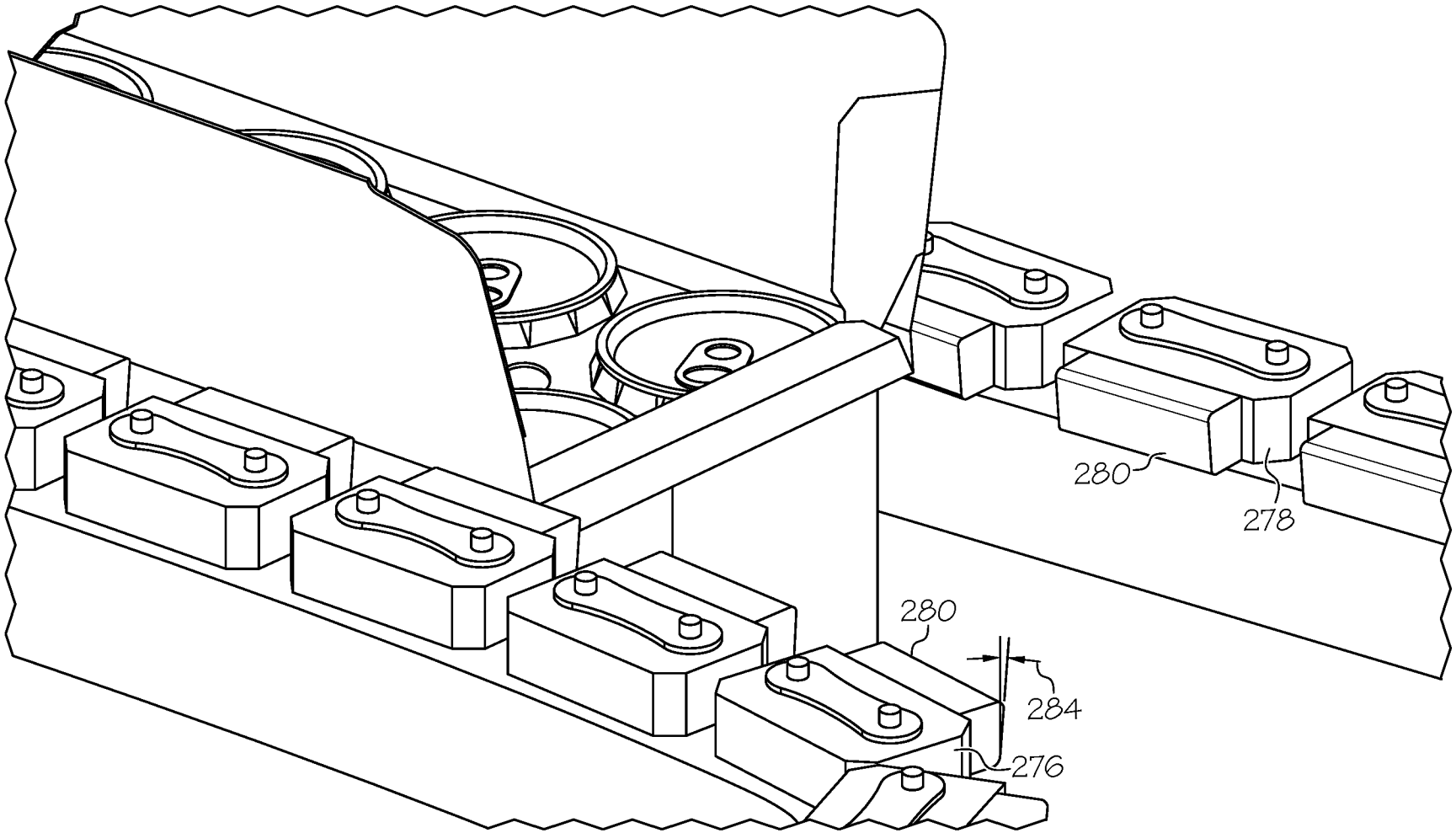
FIG. 19 is a schematic, perspective view of an example of a portion of the packaging system.

Referring now to FIGS. 17-19, which schematically illustrate a portion of the packaging system 100 and, more particularly, a portion of the alignment machine 230. In one or more examples, the alignment machine 230 includes a first alignment block 276. The first alignment block 276 is configured to engage the first side panel 110 after the first side panel 110 is folded upward to an orientation that is approximately perpendicular to the main panel 108. In one or more examples, the alignment machine 230 includes a second alignment block 278. The second alignment block 278 is configured to engage the second side panel 112 after the second side panel 112 is folded upward to an orientation that is approximately perpendicular to the main panel 108.

In one or more examples, each one of the first alignment block 276 and the second alignment block 278 includes an alignment surface 280. The alignment surface 280 is oriented at an alignment angle 284 (e.g., as shown in FIGS. 18 and 19) relative to a vertical plane. In one or more examples, the alignment angle 284 is complementary to the predetermined angle 282 of the first side panel 110 and the second side panel 112 (e.g., as shown in FIG. 20).

In one or more examples, the first alignment block 276 and the second alignment block 278 are configured to travel with the blank 106 as the group of articles 102 and the blank 106 travel along the packaging path.

In one or more examples, the alignment machine 230 includes a drive mechanism 286 (e.g., as shown in FIG. 11). The drive mechanism 286 is configured to move the first alignment block 276 into engagement with the first side panel 110 as the group of articles 102 and the blank 106 travel along a portion of the packaging path. The drive mechanism 286 is further configured to move the second alignment block 278 into engagement with the second side panel 112 as the group of articles 102 and the blank 106 travel along a portion of the packaging path. In one or more examples, the drive mechanism 268 includes any suitable drive, such as a continuous chain or belt and drive motor, that is configured to move first alignment block 276 and the second alignment block 278.

In one or more examples, the drive mechanism 286 is further configured to move the first alignment block 276 and the second alignment block 278 with the blank 106 as the group of articles 102 and the blank 106 travel along a portion of the packaging path.

In one or more examples, the first alignment block 276 is configured to maintain the first side panel 110 at the predetermined angle 282 relative to the main panel 108 while the first cover panel 118 of the blank 106 is folded relative to the first side panel 110. In one or more examples, the second alignment block 278 is configured to maintain the second side panel 112 at the predetermined angle 282 relative to the main panel 108 while the second cover panel 120 of the blank 106 is folded relative to the second side panel 112.

In one or more examples, the packaging system 100 includes a forming machine 288. The forming machine 288 is configured to couple the first cover panel 118 and the second cover panel 120 to each other. In one or more examples, the first alignment block 276 is configured to maintain the first side panel 110 at the predetermined angle 282 relative to the main panel 108 and the second alignment block 278 is configured to maintain the second side panel 112 at the predetermined angle 282 relative to the main panel 108 while the first cover panel 118 and the second cover panel 120 are coupled to each other.

Positioning and maintaining the first side panel 110 and the second side panel 112 at the predetermined angle 282 facilitates proper alignment of the first cover panel 118 and the second cover panel 120 with respect to each other while folding the first cover panel 118 and the second cover panel 120 in the overlapping relationship. Positioning and maintaining the first side panel 110 and the second side panel 112 at the predetermined angle 282 facilitates proper vertical registration of the locking element 138 and the lock opening 136 of the locking structure 134 while securing the first cover panel 118 and the second cover panel 120 together.

In one or more examples, the forming machine 288 includes a wheel assembly 314 and at least one punch 316 coupled to the wheel assembly 314. The wheel assembly 314 is driven by a drive shaft (not shown). A drive mechanism (not shown), such as a servo motor, is used to rotate the wheel assembly 314. Rotation of the wheel assembly 314 brings the punch 316 into contact with the composite top panel structure 206 to form (e.g., punch) the locking structure 134 through the first cover panel 118 and the second cover panel 120. For examples, the punch 316 is configured to insert and engage the locking element 138 within the lock opening 136 and, optionally, the handle aperture 132.

In other examples, the forming machine 288 may include additional or alternative components and/or operate in different manners. In one or more examples, the forming machine 288 may include, or take the form of, any one of various other machines or tool heads configured to secure the first cover panel 118 and the second cover panel together 120 in the overlapping relationship to finish the carton 104.

In one or more examples, the alignment machine 230 includes a series (e.g., a plurality) of first alignment blocks 276 configured to engage the first side panel 110 after the first side panel 110 is folded upward to an orientation that is approximately perpendicular to the main panel 108. In one or more examples, the alignment machine 230 includes a series (e.g., a plurality) of second alignment blocks 278 configured to engage the second side panel 112 after the second side panel 112 is folded upward to an orientation that is approximately perpendicular to the main panel 108.

By way of examples, the present disclosure is directed to a packaging method. In one or more examples the packaging method facilitates the group of articles 102 being packaged within the carton 104 by forming the blank 106 about the articles 102. In one or more examples, the packaging method is a continuous motion packaging method for continuously packaging the group of articles 102 within the carton 104. In one or more examples, the packaging method facilitates continuous processing of multiple blanks 106 to form (e.g., construct or assemble) multiple completed cartons 104 filled with multiple groups of the articles 102 (e.g., multiple completed packages 234). In one or more examples, the packaging method is implemented using the packaging system 100.

In one or more examples, the method includes a step of conveying the group of articles 102 and the blank 106, applied to the upper end 246 of the articles 102, along the packaging path. In one or more examples, the group of articles 102 and the blank 106 are conveyed along the packaging path using the conveyor 236.

In one or more examples, the method includes a step of folding the first end panel 142 of the blank 106 relative to the main panel 108 of the blank 106 as the group of articles 102 and the blank 106 travel along a portion of the packaging path. In one or more examples, the first end panel 142 is folded into the folded position using the first lower folding arm 250 of the folding machine 228.

In one or more examples, the method includes a step of folding the second end panel 144 of the blank 106 relative to the main panel 108 of the blank 106, after folding the first end panel 142, as the group of articles 102 and the blank 106 travel along a portion of the packaging path. In one or more examples, the second end panel 144 is folded into the folded position using the second lower folding arm 252 and/or the upper folding arm 270 of the folding machine 228.

In one or more examples, the method includes a step of folding the first end flap 150 of the blank 106 relative to the first end panel 142, after folding the first end panel 142, as the group of articles 102 and the blank 106 travel along a portion of the packaging path. In one or more examples, the first end flap 150 is folded into the folded position using the end-flap fold guide 262 of the folding machine 228.

In one or more examples, the method includes a step of folding the second end flap 152 of the blank 106 relative to the second end panel 144, after folding the second end panel 144, as the group of articles 102 and the blank 106 travel along a portion of the packaging path. In one or more examples, the second end flap 152 is folded into the folded position using the second lower folding arm 252 and/or the upper folding arm 270 of the folding machine 228.

In one or more examples, the method includes a step of folding the first anchor flap 158 and the second anchor flap 160, after folding the first end flap 150, as the group of articles 102 and the blank 106 travel along a portion of the packaging path. In one or more examples, the first anchor flap 158 and the second anchor flap 160 are folded into the folded positions using the anchor-flap fold guide 264 of the folding machine 228.

In one or more examples, the method includes a step of folding the third anchor flap 162 and the fourth anchor flap 164, after folding the second end flap 152, as the group of articles 102 and the blank 106 travel along a portion of the packaging path. In one or more examples, the third anchor flap 162 and the fourth anchor flap 64 are folded into the folded positions using the anchor-flap fold guide 264 of the folding machine 228.

In one or more examples, the method includes a step of securing the group of articles 102 and the blank 106 while folding the first end panel 142, the second end panel 144, the first end flap 150, the second end flap 152, the first anchor flap 158, the second anchor flap 160, the third anchor flap 162, and the fourth anchor flap 164 into the folded positions as the group of articles 102 and the blank 106 travel along a portion of the packaging path. In one or more examples, the group of articles 102 and the blank 106 are secured using the upper lug 272 of the packaging system 100.

In one or more examples, the method includes a step of indexing the blank 106 while folding the first end panel 142, the second end panel 144, the first end flap 150, the second end flap 152, the first anchor flap 158, the second anchor flap 160, the third anchor flap 162, and the fourth anchor flap 164 into the folded positions as the group of articles 102 and the blank 106 travel along a portion of the packaging path. In one or more examples, the blank 106 is indexed using the post 274 of the packaging system 100.

In one or more examples, the method includes a step of folding the first side panel 110 of the blank 106 relative to the main panel 108, after folding the first end flap 150 and the second end flap 152, as the group of articles 102 and the blank 106 travel along a portion of the packaging path. In one or more examples, the first side panel 110 is folded into the folded position using the side-panel fold guide 306 of the folding machine 228.

In one or more examples, the method includes a step of folding the second side panel 112 of the blank 106 relative to the main panel 108, after folding the first end flap 150 and the second end flap 152, as the group of articles 102 and the blank 106 travel along a portion of the packaging path. In one or more examples, the second side panel 112 is folded into the folded position using the side-panel fold guide 306 of the folding machine 228.

In one or more examples, the method includes a step of positioning the first side panel 110 and the second side panel 112 at the predetermined angle 282 relative to the main panel 108, after folding the first side panel 110 and the second side panel 112. In one or more examples, the first side panel 110 and the second side panel 112 are positioned using the first alignment block 276 and the second alignment block 278 of the alignment machine 230.

In one or more examples, the method includes a step of folding the first cover panel 118 of the blank 106 relative to the first side panel 110, while maintaining the first side panel 110 at the predetermined angle 282, as the group of articles 102 and the blank 106 travel along a portion of the packaging path. In one or more examples, the first cover panel 118 is folded into the folded position using the cover-panel fold guide 308 of the folding machine 228.

In one or more examples, the method includes a step of folding the second cover panel 120 of the blank 106 relative to the second side panel 112, while maintaining the second side panel 112 at the predetermined angle 282, as the group of articles 102 and the blank 106 travel along a portion of the packaging path. In one or more examples, the second cover panel 120 is folded into the folded position using the cover-panel fold guide 308 of the folding machine 228.

In one or more examples, the method includes a step of securing the first cover panel 118 and the second cover panel 120 to each other in an overlapping relationship. In one or more examples, the first cover panel 118 and the second cover panel 120 are secured together using the forming machine 288.

In one or more examples, the method includes a step of maintaining the first side panel 110 and the second side panel 112 at the predetermined angle 282 relative to the main panel 108, while securing the first cover panel 118 and the second cover panel 120 to each other. In one or more examples, the first side panel 110 and the second side panel 112 are maintained using the first alignment block 276 and the second alignment block 278 of the alignment machine 230.

In one or more examples, the blank 106 is formed from a sheet of suitable substrate. As used herein, the term "suitable substrate" includes all manner of foldable sheet material such as paperboard, corrugated board, cardboard, plastic, combinations thereof, and the like. It should be recognized that any number of (e.g., one or more) blanks 106 may be employed where suitable, for example, to provide and/or form one or other numbers of cartons 104 (e.g., carrier structures) described in more detail below.

In one or more examples, the blank 106 and, thus, the carton 104 are formed from a sheet material, such as a paperboard substrate. The paperboard substrate may be, for example, a solid bleached sulfate (SBS) substrate, an uncoated natural kraft (UNC) substrate, or a coated natural kraft (CNK) substrate. The paperboard substrate may be formed from virgin fibers, recycled fibers, or combinations thereof.

In one or more examples, the blank 106 and, thus, the carton 104 are formed from a sheet material such as paperboard, which may be made of materials or coated with materials to increase its strength. An example of such a sheet material is tear resistant NATRALOCK® paperboard made by WestRock Company. In one or more examples, the tear resistant materials are provided by more than one layer to help improve the tear-resistance of the carton 104.

In one or more examples, the blank 106 includes at least a paperboard substrate. The material of the paperboard substrate may be selected from any conventional paperboard, for example, ranging in weight upwardly from about 10 pt., preferably from about 16 pt. to about 28 pt. (0.028"/~0.7 mm). An example of such a substrate is a 27-point (pt.) SBS board (solid bleached sulfate paperboard coated on one side, trade name PrintKote®) or CNK® board (Coated Natural Kraft®—an unbleached kraft paperboard having a clay coating on one side, trade name CarrierKote™) manufactured by WestRock® Company. The paperboard substrate may be a bleached or unbleached board. The board may be coated on at least one side, optionally the side opposite the lamination, with a conventional coating selected for compatibility with the printing method and board composition.

In one or more examples, one surface of the sheet material has different characteristics to the other surface. For example, the surface of the sheet material that faces outwardly from a finished carton 104 may be particularly smooth and may have a coating, such as a clay coating or other surface treatment, to provide good printability. The surface of the sheet material that faces inwardly may, on the other hand, be provided with a coating, a layer, and/or a treatment or be otherwise prepared to provide properties such as one or more of tear-resistance, good glue-ability, heat sealability, or other desired functional properties.

In one or more examples, the blank 106 may include a tear resistant layer laminated to the paperboard layer. It optionally includes an adhesive layer between the paperboard substrate and the tear resistant layer. The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high-density polyolefin. The orientation and cross-laminated structure of these materials contribute to the tear resistant characteristic. Also, tear resistance may be attributed to the chemical nature of the tear resistant material such as extruded metallocene-catalyzed polyethylene (mPE).

Alternatively, in one or more examples, the tear resistant layer may be a layer of linear low-density polyethylene (LLDPE). In examples where linear low-density polyethylene (LLDPE) or mPE is used, it is not necessary to incorporate an adhesive layer. Other suitable materials having a high level of tear resistance may also be used. The adhesive layer may be formed of polyolefin material such as a low-density polyethylene (LDPE). The adhesive layer may be placed between the substrate and the tear resistant layer to secure the tear resistant layer to the substrate.

The preceding detailed description refers to the accompanying drawings, which illustrate specific examples of the disclosed packaging system and method described by the present disclosure. It will be understood that the disclosed examples are merely exemplary embodiments of the way in which certain aspects of the of the disclosed packaging system and method can be implemented and do not represent an exhaustive list of all of the ways the of the disclosed packaging system and method may be embodied. Other examples having different structures and operations do not depart from the scope of the present disclosure. Like reference numerals may refer to the same feature, element, or component in the different drawings. The figures are not necessarily to scale and some features may be exaggerated or minimized to show details of particular components. Throughout the present disclosure, any one of a plurality of items may be referred to individually as the item and a plurality of items may be referred to collectively as the items. Moreover, as used herein, a feature, element, component, or step preceded with the word "a" or "an" should be understood as not excluding a plurality of features, elements, components or steps, unless such exclusion is explicitly recited.

Illustrative, non-exhaustive examples, which may be, but are not necessarily, claimed, of the subject matter according to the present disclosure are provided above. Reference herein to "example" means that one or more feature, structure, element, component, characteristic, and/or operational step described in connection with the example is included in at least one aspect, embodiment, and/or implementation of the subject matter according to the present disclosure. Thus, the phrases "an example," "another example," "one or more examples," and similar language throughout the present disclosure may, but do not necessarily, refer to the same example. Further, the subject matter characterizing any one example may, but does not necessarily, include the subject matter characterizing any other example. Moreover, the subject matter characterizing any one example may be, but is not necessarily, combined with the subject matter characterizing any other example.

It is to be understood that not necessarily all objects or advantages may be achieved in accordance with any particular example described herein. Thus, for example, those skilled in the art will recognize that certain examples may be configured to operate in a manner that achieves or optimizes one advantage or group of advantages as taught herein without necessarily achieving other objects or advantages as may be taught or suggested herein.

It should be appreciated that, when used to modify a structure, an element, an item, a component or a feature described herein, the terms "front," "back," "rear," "bottom," "top," "left," "right," "side," "end," "upper," "lower," "inner," "outer," as well as similar terms or other forms of such terms, are relative and refer to an example of a spatial relationship between structures, elements, items, components or features. As such, examples of the blank 106 and the carton 104, described herein and illustrated in the figures, are not intended to be limited by the specific relative terms used to describe any structure, element, item, component or feature thereof.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may include a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

As used herein, the phrase "in registry with" and similar terms or variations of such term refer to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

As used herein, the terms "rotate," "rotating," "rotation," and similar terms refer to movement of a body around an axis and includes a condition in which the axis extends through a center of mass of the body (e.g., rotate), a condition in which the axis extends through the body, but not through the center of mass of the body (e.g., gyrate or pivot), and a condition in which the axis does not extend through the body (e.g., revolve).

Conditional language such as, among others, "can" or "may," unless specifically stated otherwise, are otherwise understood within the context as used in general to convey that certain examples include, while other examples do not include, certain features, elements and/or steps. Thus, such conditional language is not generally intended to imply that features, elements and/or steps are in any way required for one or more examples or that one or more examples necessarily include logic for deciding, with or without user input or prompting, whether these features, elements and/or steps are included or are to be performed in any particular example.

Unless otherwise indicated, the terms "first," "second," "third," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Those skilled in the art will appreciate that not all elements described and illustrated in FIGS. 1-20 need be included in every example and not all elements described herein are necessarily depicted in each illustrative example. Unless otherwise explicitly stated, the schematic illustrations of the examples depicted in FIGS. 1-20 are not meant to imply structural limitations with respect to the illustrative example. Rather, although one illustrative structure is indicated, it is to be understood that the structure may be modified when appropriate. Additionally, modifications, additions and/or omissions may be made to the illustrated structure.

Further, references throughout the present specification to features, advantages, or similar language used herein do not imply that all of the features and advantages that may be realized with the examples disclosed herein should be, or are in, any single example. Rather, language referring to the features and advantages is understood to mean that a specific feature, advantage, or characteristic described in connection with an example is included in at least one example. Thus, discussion of features, advantages, and similar language used throughout the present disclosure may, but do not necessarily, refer to the same example.

The described features, advantages, and characteristics of one example may be combined in any suitable manner in one or more other examples. One skilled in the relevant art will recognize that the examples described herein may be practiced without one or more of the specific features or advantages of a particular example. In other instances, additional features and advantages may be recognized in certain examples that may not be present in all examples. Furthermore, although various examples of the packaging system 100 and method have been shown and described, modifications may occur to those skilled in the art upon reading the specification. The present application includes such modifications and is limited only by the scope of the claims.

What is claimed is:

1. A system for forming a carton about articles, the system comprising:

a conveyor configured to convey a group of articles, and a blank applied to an upper end of the articles, along a packaging path;

a folding machine configured to:

fold a first end panel of the blank relative to a main panel of the blank as the group of articles and the blank travel along the packaging path;

fold a second end panel of the blank relative to the main panel of the blank, after the first end panel is folded, as the group of articles and the blank travel along the packaging path;

fold a first end flap of the blank relative to the first end panel, after the first end panel is folded, as the group of articles and the blank travel along the packaging path;

fold a second end flap of the blank relative to the second end panel, after the second end panel is folded, as the group of articles and the blank travel along the packaging path;

fold a first side panel of the blank relative to the main panel, after the first end flap and the second end flap are folded, as the group of articles and the blank travel along the packaging path;

fold a second side panel of the blank relative to the main panel, after the first end flap and the second end flap are folded, as the group of articles and the blank travel along the packaging path;

fold a first cover panel of the blank relative to the first side panel, after the first side panel is folded, as the group of articles and the blank travel along the packaging path; and fold a second cover panel of the blank relative to the second side panel, after the second side panel is folded, as the group of articles and the blank travel along the packaging path; and an alignment machine configured to position the first side panel and the second side panel at a predetermined angle relative to the main panel while the first cover panel and the second cover panel are folded.

2. A packaging system comprising:

a conveyor configured to convey a group of articles and a blank, applied to an upper end of the articles, along a packaging path; and a folding machine configured to:

fold a first end panel of the blank relative to a main panel of the blank as the group of articles and the blank travel along the packaging path; and fold a second end panel of the blank relative to the main panel of the blank, after the first end panel is folded, as the group of articles and the blank travel along the packaging path.

3. The packaging system of claim 2, wherein the folding machine is further configured to:

fold a first end flap of the blank relative to the first end panel, after the first end panel is folded, as the group of articles and the blank travel along the packaging path; and fold a second end flap of the blank relative to the second end panel, after the second end panel is folded, as the group of articles and the blank travel along the packaging path.

4. The packaging system of claim 3, wherein:

the folding machine comprises:

a lower folding wheel configured to rotate about a lower rotational axis;

a first lower folding arm projecting radially from the lower folding wheel;

a second lower folding arm projecting radially from the lower folding wheel; and a lower rotary drive configured to rotate the lower folding wheel about the lower rotational axis, wherein:

the first lower folding arm is configured to fold the first end panel upward to an orientation that is approximately perpendicular to the main panel of the blank as the lower folding wheel rotates and the group of articles and the blank pass over the lower folding wheel;

the second lower folding arm is configured to:

fold the second end panel upward to an orientation that is approximately perpendicular to the main panel as the lower folding wheel rotates and the group of articles and the blank pass over the lower folding wheel; and fold the second end flap in a direction of travel of the group of articles and the blank to an orientation that is approximately perpendicular to the second end panel as the lower folding wheel rotates and the group of articles and the blank pass over the lower folding wheel.

5. The packaging system of claim 4, wherein:

the folding machine further comprises an end-flap fold guide located above the lower folding wheel; and the end-flap fold guide is configured to fold the first end flap opposite to the direction of travel of the group of articles and the blank to an orientation that is approximately perpendicular to the first end panel as the blank travels under the end-flap fold guide.

6. The packaging system of claim 5, wherein:

the folding machine further comprises an anchor-flap fold guide located below the end-flap fold guide; and the anchor-flap fold guide is configured to:

fold a first anchor flap and a second anchor flap of the blank opposite to the direction of travel of the group of articles and the blank to an orientation that is approximately parallel to the main panel as the blank travels under the anchor-flap fold guide; and fold a third anchor flap and a fourth anchor flap of the blank in the direction of travel of the group of articles and the blank to an orientation that is approximately parallel to the main panel as the blank travels under the anchor-flap fold guide.

7. The packaging system of claim 4, wherein the first lower folding arm and the second lower folding arm are angularly displaced from each other.

8. The packaging system of claim 4, wherein:

the first lower folding arm is fixed to the lower folding wheel; and the second lower folding arm is configured to pivot about a pivot axis relative to the lower folding wheel, wherein the second lower folding arm is radially movable relative to the lower folding wheel.

9. The packaging system of claim 8, wherein:

the folding machine further comprises:

a cam track located adjacent to the lower folding wheel; and a cam follower coupled to the second lower folding arm and engaged with the cam track; and the second lower folding arm is configured to pivot about the pivot axis and radially move relative to the lower folding wheel as the cam follower moves along the cam track.

10. The packaging system of claim 4, wherein:

the folding machine further comprises:

an upper folding wheel configured to rotate about an upper rotational axis;

an upper folding arm projecting radially from the upper folding wheel; and an upper rotary drive configured to rotate the upper folding wheel about the upper rotational axis, wherein the upper folding arm is configured to:

fold the second end panel upward to the orientation that is approximately perpendicular to the main panel as the upper folding wheel rotates and the group of articles and the blank pass under the upper folding wheel; and fold the second end flap in the direction of travel of the group of articles and the blank to the orientation that is approximately perpendicular to the second end panel as the upper folding wheel rotates and the group of articles and the blank pass under the upper folding wheel.

11. The packaging system of claim 2, further comprising:

a lug configured to engage the upper end of the articles; and a post projecting downwardly from the lug and configured to be at least partially inserted through a handle aperture formed in the main panel.

12. The packaging machine of claim 2 wherein the folding machine is configured to fold the first and the second end panel upward to an orientation that is approximately perpendicular to the main panel.

13. A packaging system comprising:

a conveyor configured to convey a group of articles and a blank, folded about the articles, along a packaging path, wherein the blank comprises openings to receive the group of articles; and an alignment machine positioned and configured to position a first side panel and a second side panel of the blank at a predetermined angle relative to a main panel of the blank without obstructing the openings in the blank as the group of articles and the blank travel along the packaging path.

14. The packaging system of claim 13, wherein the alignment machine comprises:

a first alignment block configured to engage the first side panel after the first side panel is folded upward to an orientation that is approximately perpendicular to the main panel; and a second alignment block configured to engage the second side panel after the second side panel is folded upward to an orientation that is approximately perpendicular to the main panel.

15. The packaging system of claim 14, wherein:

each one of the first alignment block and the second alignment block comprises an alignment surface that is oriented at an alignment angle relative to a vertical plane; and the alignment angle is complementary to the predetermined angle of the first side panel and the second side panel.

16. The packaging system of claim 14, wherein the first alignment block and the second alignment block are configured to travel with the blank as the group of articles and the blank travel along the packaging path.

17. The packaging system of claim 16, wherein the alignment machine further comprises a drive mechanism configured to:

move the first alignment block into engagement with the first side panel as the group of articles and the blank travel along the packaging path; and move the second alignment block into engagement with the second side panel as the group of articles and the blank travel along the packaging path.

18. The packaging system of claim 17, wherein the drive mechanism is further configured to move the first alignment block and the second alignment block with the blank as the group of articles and the blank travel along the packaging path.

19. The packaging system of claim 16, wherein:

the first alignment block is configured to maintain the first side panel at the predetermined angle relative to the main panel while a first cover panel of the blank is folded relative to the first side panel; and the second alignment block is configured to maintain the second side panel at the predetermined angle relative to the main panel while a second cover panel of the blank is folded relative to the second side panel.

20. The packaging system of claim 19, further comprising a forming machine configured to couple the first cover panel and the second cover panel to each other, wherein the first alignment block is configured to maintain the first side panel at the predetermined angle relative to the main panel and the second alignment block is configured to maintain the second side panel at the predetermined angle relative to the main panel while the first cover panel and the second cover panel are coupled to each other.

21. The packaging system of claim 13, wherein the alignment machine comprises:

a series of first alignment blocks configured to engage the first side panel after the first side panel is folded upward to an orientation that is approximately perpendicular to the main panel; and a series of second alignment blocks configured to engage the second side panel after the second side panel is folded upward to an orientation that is approximately perpendicular to the main panel.

* * * * *